US009215758B2

(12) United States Patent
Imura

(10) Patent No.: US 9,215,758 B2
(45) Date of Patent: Dec. 15, 2015

(54) STOVETOP INTERFACE, SYSTEM AND METHODS OF TEMPERATURE CONTROL OF COOKWARE, AND METHODS OF COOKING USING NUMERICAL TEMPERATURE CONTROL

(75) Inventor: Mamoru Imura, Tokyo (JP)

(73) Assignee: IMURA INTERNATIONAL USA, INC., Shawnee, KS (US)

( * ) Notice: Subject to any disclaimer, the term of this patent is extended or adjusted under 35 U.S.C. 154(b) by 0 days.

(21) Appl. No.: 13/539,940

(22) Filed: Jul. 2, 2012

(65) Prior Publication Data

US 2013/0140292 A1 Jun. 6, 2013

Related U.S. Application Data

(63) Continuation-in-part of application No. 11/561,415, filed on Nov. 19, 2006, now Pat. No. 8,212,189, which is a continuation-in-part of application No. 11/148,802, filed on Jun. 9, 2005, now Pat. No. 7,875,836, and a continuation-in-part of application No. 10/833,356, filed on Apr. 28, 2004, now Pat. No. 7,157,675.

(60) Provisional application No. 60/738,259, filed on Nov. 18, 2005.

(51) Int. Cl.
*H05B 1/02* (2006.01)
*F24C 7/08* (2006.01)

(52) U.S. Cl.
CPC ..... *H05B 1/0266* (2013.01); *F24C 7/082* (2013.01); *F24C 7/083* (2013.01)

(58) Field of Classification Search
CPC ..... H05B 1/02; H05B 1/0266
USPC ..... 219/492, 494, 412–415, 448.11, 219/448.12, 506, 487, 489, 710, 720
See application file for complete search history.

(56) References Cited

U.S. PATENT DOCUMENTS

| | | | | |
|---|---|---|---|---|
| 3,819,906 | A * | 6/1974 | Gould, Jr. | 219/506 |
| 4,255,639 | A * | 3/1981 | Kawabata et al. | 219/710 |
| 4,383,157 | A * | 5/1983 | Nakata et al. | 219/711 |
| 4,390,766 | A * | 6/1983 | Horinouchi | 219/718 |
| 4,517,431 | A * | 5/1985 | Ueda | 219/719 |
| 5,369,253 | A * | 11/1994 | Kuwata et al. | 219/707 |
| 5,767,488 | A * | 6/1998 | Barger et al. | 219/492 |
| 7,445,381 | B2 * | 11/2008 | Rund et al. | 374/102 |
| 2003/0094448 | A1 * | 5/2003 | Shukla et al. | 219/487 |

* cited by examiner

*Primary Examiner* — Mark Paschall
(74) *Attorney, Agent, or Firm* — Kutak Rock LLP; Bryan P. Stanley

(57) ABSTRACT

A temperature control interface for a stove top is provided. The temperature control interface includes a numerical temperature setting to which a temperature of an object heated on the stovetop will be regulated for a predetermined period of time. A method of cooking on a stovetop is provided in which a recipe includes a numerical temperature to which a cookware object should be regulated during cooking for a predetermined period of time.

15 Claims, 15 Drawing Sheets

STOVETOP INTERFACE, SYSTEM AND METHODS OF TEMPERATURE CONTROL OF COOKWARE, AND METHODS OF COOKING USING NUMERICAL TEMPERATURE CONTROL

This application claims priority pursuant to 35 U.S.C. 119 (e) to U.S. Provisional Patent Application Ser. No. 60/738,259, filed Nov. 18, 2005, the entire disclosure of which is incorporated herein by reference. This application is a continuation-in-part of U.S. application Ser. No. 11/561,415 filed Nov. 19, 2006, which is a continuation-in-part of U.S. application Ser. No. 10/833,356 filed Apr. 28, 2004 and U.S. application Ser. No. 11/148,802, filed Jun. 9, 2005, the disclosures of which are incorporated herein by reference in their entireties.

FIELD OF THE INVENTION

The present invention is broadly concerned with cookware and cooking appliances. More particularly, the invention is concerned with: temperature regulated cookware and servingware items, such as pots, pans, buffet serving pans, serving dishes, platters, and the like; a temperature control interface for manual control of a stovetop; and methods of cooking on a stovetop using a numerical control interface.

BACKGROUND OF THE INVENTION

Cooking is often referred to as an art, not only because of the combination of ingredients that go into a particular recipe, but also due to the skill necessary for proper application and infusion of varying levels of heat over a given period of time throughout the different phases of the food preparation process. Traditional cookware appliances, such as ovens (microwave ovens being an exception), grills, heat lamps and stoves, all utilize the thermodynamic process of conduction to transfer heat from the outer surface of the food item to its interior. This is generally true regardless of the type of heat source used to heat the surface of the food, be it a radiation heat source (i.e. a heat lamp), conduction heat source (i.e. a stovetop), or a convection heat source (i.e. a convection oven or a food dehydrator).

The use of thermometers or other temperature sensors to monitor and control the cooking process is well known. A common thermometer used to monitor and control the cooking process is a probe-type or contact thermometer which is inserted directly into the food item to obtain a temperature of the interior of the food item. Such thermometers are undesirable for use with cookware/servingware objects that have a lid as the use of a probe-type thermometer requires removal of the lid each time a temperature reading is taken. A number of cookware-associated non-contact thermometers have been developed that are attached to, or incorporated into, cookware objects such as pots and pans. For example, my invention disclosed in U.S. patent application Ser. No. 10/833,356, which is incorporated herein by reference in its entirety, provides a means of obtaining consistent and accurate measurement and control of the temperature of a cookware object, such as a pot or pan, by embedding a temperature sensor within a heatable portion of an object, such as within a tunnel through the base of the pot or pan. The temperature sensor is connected to an RFID tag located apart from the heatable portion of the pot or pan. The RFID tag acts as a transmitter (and sometimes as receiver) to communicate with a reader/writer located in a cook-top for heating the object, providing temperature information and other information regarding the object (such as heating characteristics) to the cook-top. The temperature information and the heating information are used by the cook-top to control the temperature of the object.

My prior invention in which the temperature sensor is embedded within a tunnel in the base, as disclosed in U.S. patent application Ser. No. 10/833,356, and in U.S. application Ser. No. 11/148,802 filed Jun. 9, 2005 (the disclosure of which is incorporated herein in its entirety), provides a highly effective way of regulating temperature during cooking. This allows a selected cooking temperature to be maintained while cooking on a stovetop. The cooking temperature can be programmed into the stovetop in the manner described in U.S. Pat. No. 6,953,919 (the entire disclosure of which is incorporated herein by reference), or the temperature can be selected manually (as is also disclosed in U.S. Pat. No. 6,953,919). Notwithstanding, although a desired cooking temperature may be manually selected by the cook, stovetop control interfaces of the prior art do not provide the cook any indication of the actual temperature that is being selected. For example, referring to FIG. 1, a dial-type stovetop control interface of the prior art is shown. Similar control interfaces are common on all types of stovetops, including induction, gas, electric, radiant, halogen, etc. The control interface shown in FIG. 1 allows the cook to select a temperature based upon a quantitative descriptor such as "simmer", "low", "medium", or "high". Turning the knob to "medium" may always heat the pan to 120 degrees C. (and this may in fact be preprogrammed into the stovetop, such as in the manner disclosed in U.S. Pat. No. 6,953,919), but unless the cook has measured the temperature with his/her own thermometer, he/she has no way of knowing the exact temperature. This is because the quantitative descriptors (i.e. "simmer", "low", "medium", or "high") are arbitrarily matched to specific temperatures by the stovetop manufactures. Thus, "med" on one stovetop may be 120 C, while on another stovetop, it will be 150 C. Also, these arbitrary quantitative temperature descriptors may vary depending upon the type of stovetop, i.e. induction, gas, electric, radiant, etc., due to the fact that the maximum heat that may be generated by each source will vary (e.g. gas 1300 C, radiant 800 C). Therefore, it would be beneficial to provide a stovetop temperature control interface that allows the cook to know the exact temperature that is manually being selected.

Furthermore, stovetop recipes traditionally utilize the same arbitrary quantitative descriptors (i.e. "simmer", "low", "medium", or "high") as are used on stovetops. Thus, due to the large degree of variance between different brands of stovetops and sources of heat (i.e. induction, gas, electric, etc.), as well as variations due to different altitudes, the recipes must be altered (or the cooks must know to vary the temperature) to avoid the dishes being improperly cooked. Therefore, it would be beneficial to provide a method of stovetop cooking that provides more consistent results regardless of the stovetop being used and the altitude at which a dish is prepared.

SUMMARY OF THE INVENTION

An object of the instant invention is to provide temperature regulated items (or objects). Another object of the instant invention is to provide a stovetop temperature control interface that allows the cook to know the exact temperature that is manually being selected. Yet another object of the instant invention is to provide a method of stovetop cooking that provides more consistent results regardless of the stovetop being used and the altitude at which a dish is prepared. Another object of the instant invention is to provide a stovetop temperature control interface that regulates the exact temperature of a cookware object for a predetermined period of time.

The above described objects are achieved using a temperature regulated object such as is described in U.S. patent application Ser. No. 10/833,356, and/or in and U.S. application Ser. No. 11/148,802 (including a heatable body, a temperature sensor, and an RFID tag (or other suitable transmitter/receiver)), and a stovetop including an RFID reader/writer (or other suitable transmitter/receiver). The stovetop further includes a temperature control interface (as is shown in FIG. 2) that allows the user to select a specific numerical temperature to which the temperature of the heatable object will be regulated for a predetermined period of time.

The heatable objects of preferred embodiments of the instant invention are constructed and operate in a manner similar to the cookware/servingware objects disclosed in U.S. patent application Ser. No. 10/833,356, and/or in and U.S. application Ser. No. 11/148,802, utilizing the same or similar components and materials, including the materials for the body of the object, the handle materials, the RFID tag, RFID reader/writer and the RTD sensor. Nevertheless, it will be appreciated that alternative manners of construction and operation may be developed without departing from the spirit and scope of the instant invention, and modifications to certain components may be made to accommodate the location of the temperature sensor in the instant invention.

Since the temperature control interface shown in FIG. 2 informs the cook of the exact numerical temperature which is being selected, stovetop recipes may be utilized based upon numerical temperature rather than the quantitative descriptors (i.e. "simmer", "low", "medium", or "high"). By providing recipes based upon specific numerical temperature values, more consistent results may be obtained regardless of the brand or power source (i.e. electric, gas, induction, etc.) for the stovetop, and regardless of the altitude. The cook simply reads the numerical temperature from the recipe and manually sets the temperature to be regulated using the control knob shown in FIG. 2.

It will be appreciated that although shown as a control knob in FIG. 2, the temperature control interface of the instant invention may comprise a digital control interface, or any other interface that allows a user to manually select a temperature and which displays the temperature being selected, whether now known or hereafter discovered. The control and temperature display may be a single unit as shown in FIG. 2, or the temperature display may be separate from the control that allows the temperature to be selected. Similarly, the temperature control interface and/or display may be combined as a single unit with a timing control selector and/or timing display (not shown in FIG. 2), or the temperature control and/or display may be separate from the timing control and/or timing display. The predetermined period of time during which the temperature is regulated may be automatically selected as part of a recipe from stored memory, or the predetermined period of time may be manually selected. Furthermore, it will be appreciated that the control interface of the instant invention, and the method of cooking utilizing the control interface, may be utilized with temperature controllable cookware that includes temperature sensors that communicate with the stovetop (as described in U.S. patent application Ser. No. 10/833,356, and/or in and U.S. application Ser. No. 11/148,802), or utilizing one of numerous alternative methods now known or hereafter discovered. For example, temperature sensors may monitor the temperature of the stovetop itself, sensors within the stovetop may monitor the temperature of the cookware (i.e. infrared sensors), or cooking temperature can be controlled based upon the amount of power being provided by the stovetop.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims. The accompanying drawings are being provided for the purpose of illustration. The general inventive concept is not limited to the precise arrangements and instrumentalities shown.

DETAILED DESCRIPTION OF A PREFERRED EMBODIMENT

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
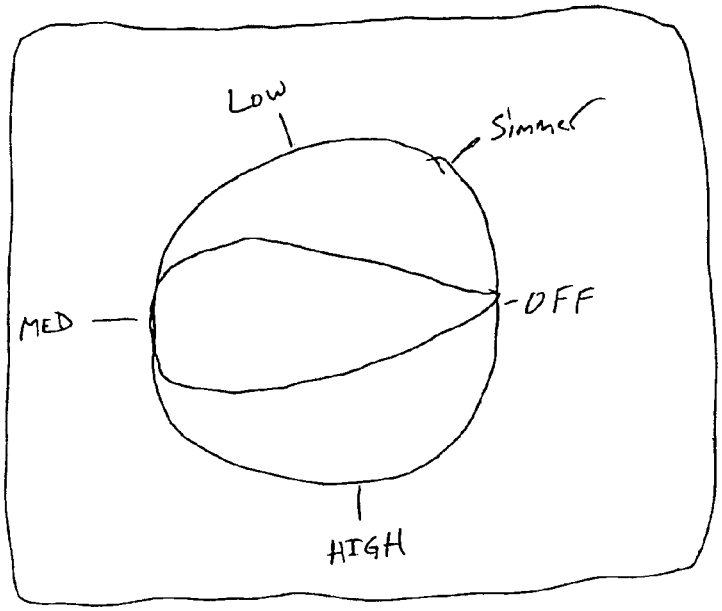
Fig 1 (Prior Art)
FIG. 1 is a top view of a stovetop temperature control interface of the prior art.
Figure 2:
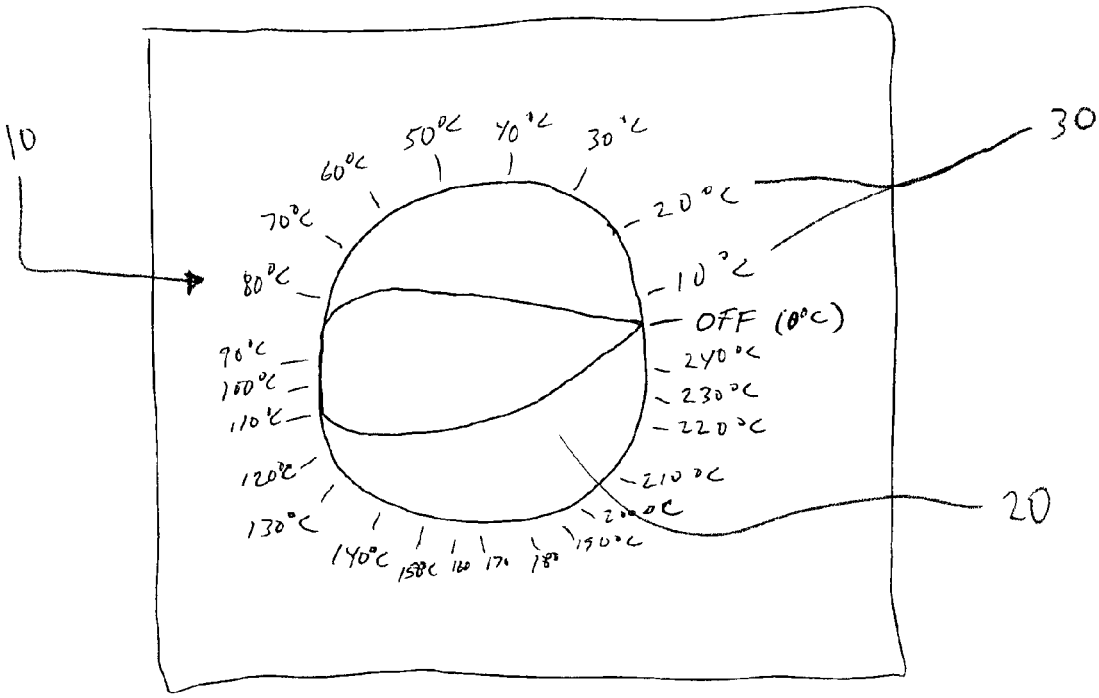
FIG. 2 is a top view of a stovetop temperature control interface of the instant invention.

Referring to FIG. 2 a stovetop temperature control interface, 10, of the instant invention is shown. Interface 10 includes control knob 20 (temperature selector) and incremental numerical temperature settings 30. In operation control knob 20 is adjusted by an operator (i.e. a cook) by turning the knob to the temperature setting 30 corresponding to a numerical temperature that is desired to be used for cooking. In the preferred embodiment the cooking temperature is a numerical temperature that is set forth in a recipe. For example, a recipe may specify that a food item should be heated for 20 minutes at 100 degrees Celsius. In such case, control knob 20 is turned to the temperature setting (30) reading 100 degrees Celsius. The temperature of a cookware object located on the stovetop may then be controlled in a manner similar to that described in U.S. Pat. No. 6,953,919 such that the temperature of the object is maintained at 100 degrees Celsius for a predetermined period of time, in this example, for 20 minutes as specified in the recipe.

In some embodiments, the instant inventive concept includes a processor to control the period of time during which the temperature is regulated. The processor controls the power of the stovetop hob for the predetermined period of time. The period of time may be selected automatically or manually. The period of time may be selected automatically when it is included with a recipe in electronic memory storage. The period of time may be selected manually by a user via a timing control selector. The processor regulates the temperature of the cookware object placed on the stovetop hob for the predetermined period of time. Optionally, the interface includes a timer display to show the remaining amount of the period of time.

For example, a user uses the temperature control selector to manually select a temperature of 100 degrees Celsius and then uses the timing control selector to manually select a predetermined period of time of 20 minutes. A display shows the temperature setting (100 degrees Celsius) and another (or the same) display shows the remaining time of the 20 minutes. When the predetermined period of time (20 minutes) concludes, the stovetop enters a new phase of cooking. The new phase of cooking may include maintaining the temperature of the cookware object at its current temperature, ceasing to heat the stovetop hob to allow the cookware object to cool to ambient temperature, or any other new phase of cooking that includes a new temperature and/or timing component.

In some embodiments, the instant inventive concept further includes a processor to regulate the temperature for a second period of time. The temperature to be regulated for a second period of time may be the same as the temperature previously selected or it may be a different temperature that is selected automatically via a recipe or manually via a user using the control selector. The second period of time may be the same as the first period of time or it may be a different period of time that is selected automatically via a recipe or manually via a user using the timing control selector. The processor may be the same as the previously described processors or it may be a new and separate component.

For example, a user uses the temperature control selector to manually select the temperature of 100 degrees Celsius and then uses the timing control selector to manually select a first predetermined period of time of 20 minutes. The user then uses the temperature control selector to manually select a second temperature of 80 degrees Celsius and then uses the timing control selector to manually select a second predetermined period of time of 40 minutes. The processor controls the power to the stovetop hob to regulate the temperature of the cooktop object at 100 degrees Celsius for 20 minutes. At the conclusion of 20 minutes, the processor controls the power to the stovetop hob to regulate the temperature of the cooktop object at 80 degrees Celsius for 40 minutes. As will be appreciated by those having skill in the art, any of the first or subsequent temperature settings and any of the first or subsequent timing settings may be entered manually or automatically.

A cookware object, such as a pot or pan, constructed in the manner disclosed in U.S. patent application Ser. Nos. 10/833,356 and 11/148,802 is placed on a hob of the stovetop that is controlled by control knob 20. The cookware object includes an RFID tag that is connected to a temperature sensor embedded in a tunnel in the heatable portion of the object. The temperature sensor measures the temperature of the object as it is being heated by the stovetop. The RFID tag communicates via RF signals with an RFID reader/writer located in the stovetop. The RFID reader/writer is connected to a processor that is also connected to interface 10 and to the power source for the hob of the stovetop. The processor receives temperature information measured by the temperature sensor of the object via the RF transmission from the RFID tag to the RFID reader/writer. The processor then utilizes that information to control the power source for the hob to regulate the temperature of the cookware object to the temperature set by control knob 20 for a predetermined period of time. For example, if the temperature reading from the temperature sensor is lower than the temperature set by control knob 20 the processor will increase power (or maintain the current power if it is providing appropriate heating energy) to the power source for the hob so that the object is heated. If the temperature reading by the temperature sensor is at or above the temperature set by control knob 20 the processor will decrease power. If the heating source is an induction heating source, the increase or decrease in power is an increase or decrease (or termination of) in electric current through an induction coil. If the heating source is gas, the increase or decrease in power will be by controlling a gas valve to increase or decrease (or terminate) the flow of gas to the cooking hob. It will be appreciated, that any other heating source now known or hereinafter developed (including but not limited to electric, gas, or induction) may be used in connection with the control interface and methods of the instant invention.

Although incremental temperature settings 30 are shown in FIG. 2 in increments of ten degrees Celsius, it will be appreciated that other increments (such as five degrees, one degree, fractions of a degree, etc.) may be utilized without departing from the spirit and scope of the instant invention. Furthermore, it will be appreciated that other units of measurement (such as degrees Fahrenheit) may be utilized without departing from the spirit and scope of the instant invention.

Figure 3:
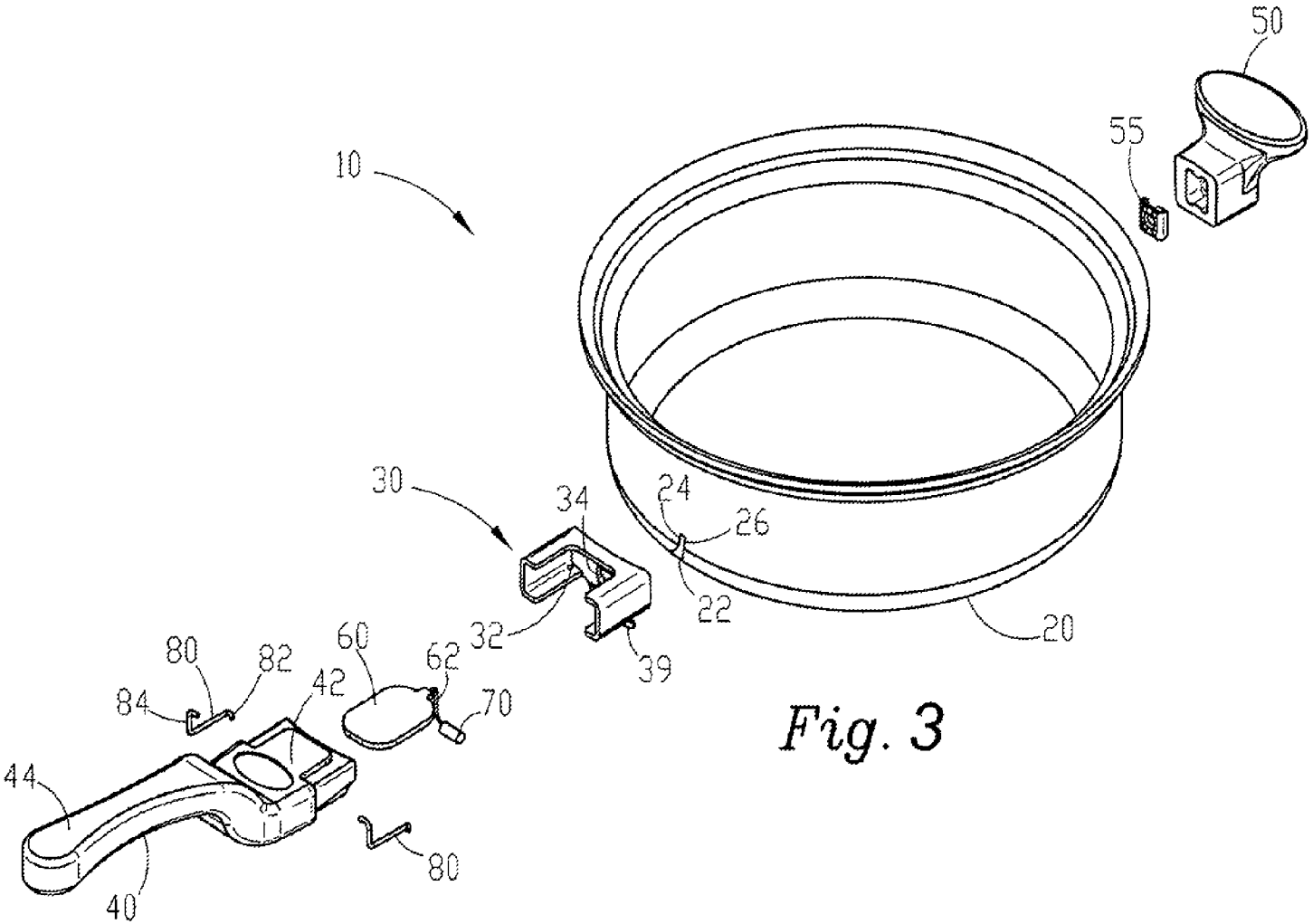
FIG. 3 is an exploded perspective view of a RFID controlled frying pan exemplary of the instant invention in which a temperature sensor is positioned in a notch in the side of the pan.
Figure 5:
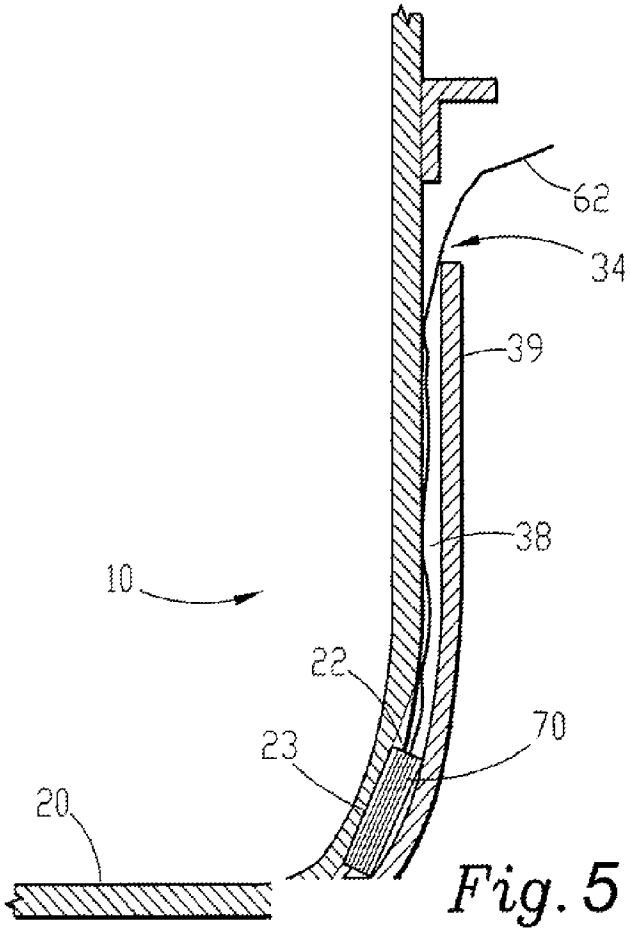
FIG. 5 is a partial section view taken along line A-A of FIG. 4 showing the notched side and corresponding temperature sensor in detail.
Figure 4:
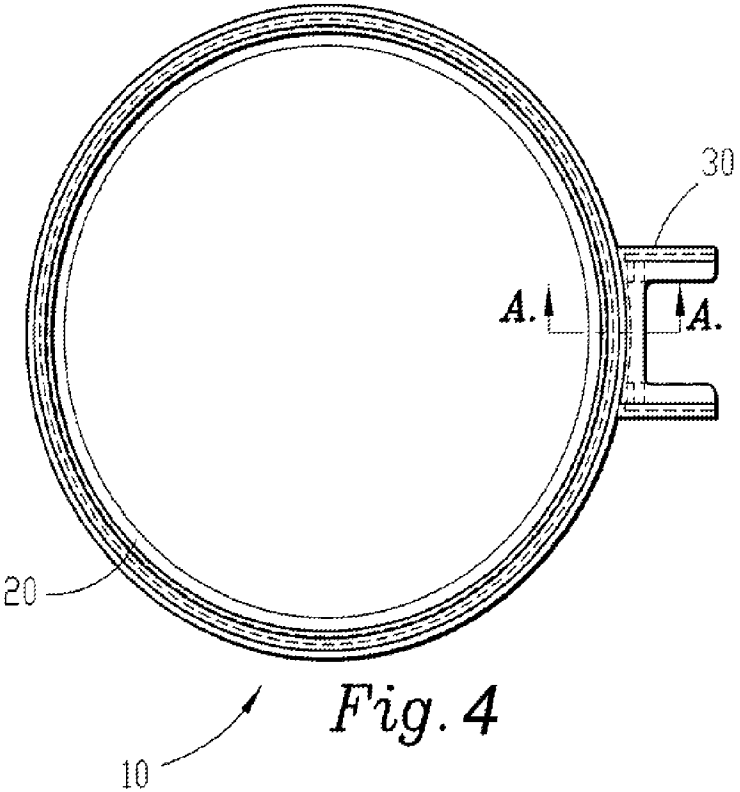
FIG. 4 is a partial top plan view of the RFID controlled frying pan shown in FIG. 3.

Referring to FIGS. 3 through 5, a first embodiment of an RFID controlled cookware object, in the form of a frying pan is shown. FIG. 3 shows an exploded view of cookware object 10 including pan body 20, primary handle 40, and secondary (helper) handle 50. Primary handle 40 is connected to pan body 20 via bracket/receiver 30. Spring clips 80 releasably secure primary handle 40 to receiver 30 through the engagement of clip ends 82 with holes 32 in receiver 30. Helper handle 50 is connected to pan body 20 via bracket 55. An RFID tag, 60, is connected to temperature sensor 70 via a pair of wires, 72. RFID tag 60 is stored in a cavity located within handle 40. Wires 72 extend from the interior of the cavity through a portal 34 of receiver 30 to sensor 70 which is generally located between receiver 30 and the exterior of pan body 20 within notch 22 formed into the side of pan body 20.

Pan body 20 is fabricated from materials and manufactured by means well known in the art. Types of materials commonly used for fabrication of pan body 20 include, but are not limited to, cast iron, stainless steel, aluminum, aluminum alloys, copper, copper-clad stainless steel, etc. In a preferred embodiment, pan body 20 is fabricated to be used for induction cooking. Although a number of materials can be utilized for fabrication of a pan body capable of induction heating, the construction of a multi-ply body comprising layers of several different materials is quite common. The specific material used for each ply or layer, the thickness of each layer, and the total number of layers will vary depending upon the size, shape, desired appearance and desired heating characteristics of the pan. In an exemplary embodiment, pan body 20 is a 5-ply construction, including a first layer of magnetic stainless steel forming the interior cooking surface of the pan, a second inner-layer of 3003 pure aluminum, a third inner-layer of 1145 aluminum alloy, a fourth inner-layer of 1145 aluminum, and a fifth layer of magnetic stainless steel forming the exterior surface of the pan. The two surface layers of magnetic stainless steel provide strength, durability, easy cleaning and a long-lasting, attractive appearance to the pan body. The exterior surface layer of magnetic stainless steel builds up heat generated from a stove cook-top (either by conduction in a traditional stove, or by induction utilizing the ferromagnetic properties of the steel in an induction stove) generally at the center of the base of the pan body. The three layers of aluminum and aluminum alloy, which form an aluminum core for the pan, absorb heat quickly from the exterior layer of steel, and smoothly and evenly distribute the heat through conduction across the bottom and sides of the pan body to the inner layer of steel.

Figure 8:
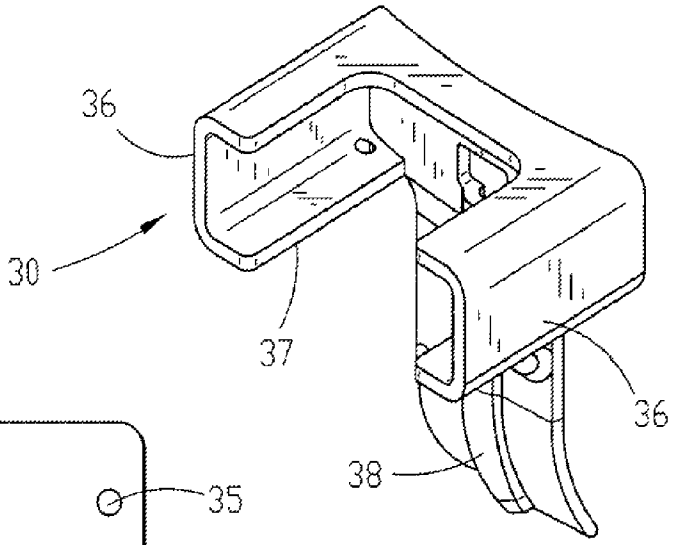
FIG. 8 is a frontal perspective view of the receiver of FIG. 6.
Figure 7:
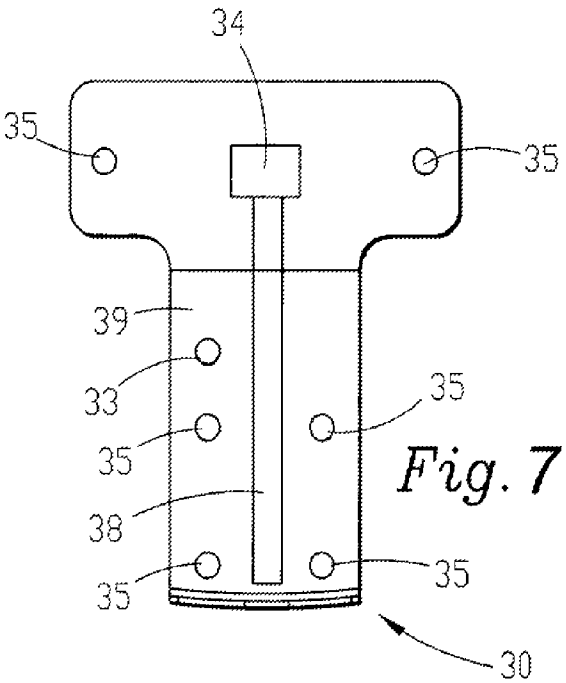
FIG. 7 is a rear elevation view of the receiver of FIG. 6.
Figure 6:
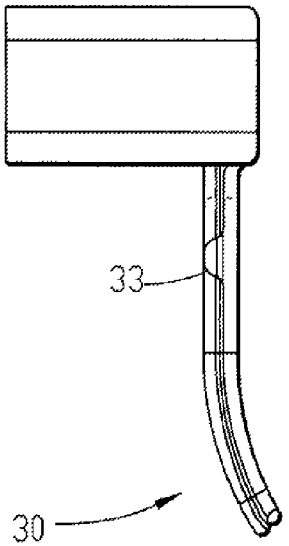
FIG. 6 is a side elevation view of a receiver for connecting a handle to the frying pan shown in FIG. 3.

FIGS. 6 through 8 show detail views of receiver 30 for use with the RFID controlled cookware object shown in FIGS. 3 through 5. Receiver 30 includes support members 36 for engaging handle 40. Spring clips 80 frictionally engage with support member 36 to releasably secure handle 40 to receiver 30. Support members 36 of receiver 30 perform several functions, one is to support handle 40 in the manner described above, another is to increase and/or concentrate the transmission signal strength between tag 60 and a reader/writer located below the surface of a cook-top. The transmission signal is increased and/or concentrated through the use of window 37 that is formed between the lower interior edges of opposing support members 36. Window 37 provides a generally unobstructed transmission zone between tag 60 and the reader/writer of the cook-top. The size and shape of window 37 is adjusted based upon the particular arrangement of the antenna of pan tag 60 to help tune the transmission signal by reducing obstruction between the antenna of pan tag 60 and the antenna of the reader/writer located in the cook-top.

FIGS. 4 and 5 show detail views of receiver 30 in attached engagement with pan body 20, wherein handle 40 has been removed. Receiver 30 includes member 39 extending downward from support members 36 to the base of pan body 20. Channel 38 is formed in member 39 to permit wires 62 and sensor 70 to be located in the cavity created between member 39 of receiver 30 and pan body 20. Member 39 covers notch 22 and sensor 70 which is located in notch 22. Notch 22 is machined (EDM, CNC, etc.) into the side of pan body 20 exposing the aluminum core and permitting contact of the aluminum core by sensor 70. The lower-most portion of member 39 extends beyond the bottom of sensor 70 and inward to surround sensor 70 and provide a clean, generally flush base for the assembled combination of pan body 20 and receiver 30.

Receiver 30 is manufactured of a metal such as steel, aluminum alloy, or any other material suitable for supporting handle 40 to pan body 20. In the preferred embodiment described herein, in which pan body 20 is heated by induction, receiver 30 is manufactured from a non-ferromagnetic material, such as non-magnetic stainless steel, to reduce the possibility that receiver 30 will be heated by the magnetic field of the cook-top. Receiver 30 includes recess 33 which corresponds to a locator (not shown) protruding from pan body 20. The combination of the locator and recess 33 ensures proper alignment of receiver 30 over notch 22 during assembly and throughout the life of cookware object 10. In a preferred embodiment, receiver 30 is welded or braised to pan body 20 for a long-lasting, durable connection, and channel 38 is filled with a potting material, such as a high temperature silicon like Loctite® 5406, to protect the exposed aluminum core of pan body 20 and to secure sensor 70 within notch 22. To aid in an automated braising process, receiver 30 includes a number of nubs (welding/braising lugs) 35 protruding from the back surface of the receiver, which contact the outer surface of pan body 20 when receiver is properly positioned over notch 22. Nubs 35 are formed of a material having a lower melting point than the material used to manufacture receiver 30, allowing nubs 35 to be melted for braising by applying heat to the surface of receiver 30 opposite nubs 35, without melting receiver 30.

Tag 60 is located within end 42 of handle 40. To position tag 60 within operating range from the reader/writer located within the cook-top, receiver 30 locates handle end 42 relatively close to the base of pan body 20. On most cookware items, such a placement of handle end 42 is much lower than normally utilized. In many instances, low placement of the handle on a cookware object can make the object difficult to handle and even unsafe, especially when the cookware object is used on traditional stoves-tops in which the burner surface gets extremely hot. To provide safer and easier handling of pan 10, handle 40 curves upward from end 42 to end 44. This allows the cook to grasp handle 40 at end 44 without being too close to the surface of the cook-top.

Figure 10:
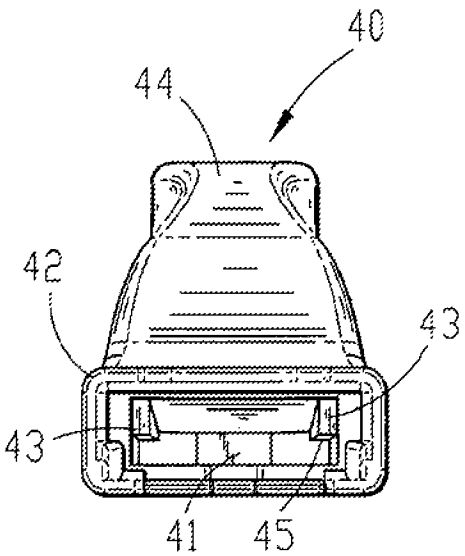
FIG. 10 is an end view of the handle shown in FIG. 9.
Figure 9:
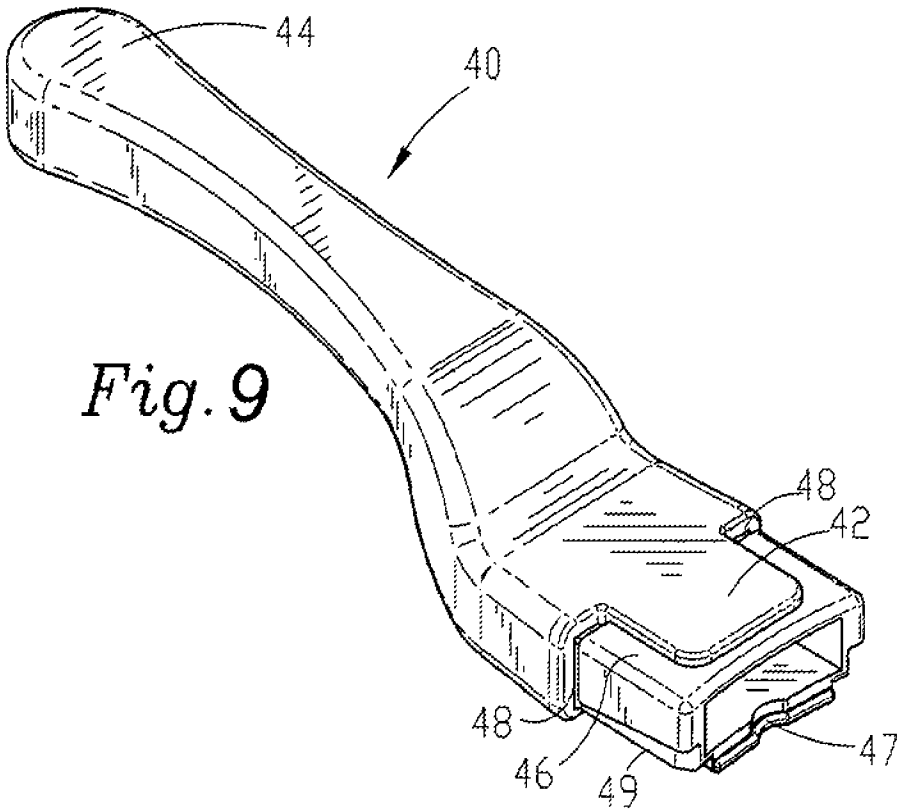
FIG. 9 is a perspective view of a handle for the frying pan shown in FIG. 3.

FIGS. 9 and 10 show handle 40 apart from pan 10. End 42 of handle 40 includes section 46 that is cut away in relief to permit handle end 42 to engage with receiver 30. In addition, the relief cutaway results in a flush outer-surface connection between handle end 42 and receiver 30, giving pan 10 a clean professional appearance. Cutaway section 46 further includes an additional relief-cut graduated ramp and groove on each side of handle 40 for receipt of spring clips 80. Grooves 48 are cut partially into the top of handle 40 and extend down each side to the bottom of handle 40. Ramps 49 are cut into each side of handle 40, originating from grooves 48 and sloping upward to the end of handle 40. Spring clips 80 are positioned into grooves 48 and ramps 49 on each side of handle 40 such that end 84 of each spring clip fits within groove 48, the main body of each spring clip extends generally along ramp 49, and opposing end 82 of each spring clip curves downward from handle 40 at the pan-side end of handle 40. As is discussed above, spring clips 80 releasably secure primary handle 40 to receiver 30 through the engagement of clip ends 82 with holes 32 in receiver 30. Ramps 49 provide room for lateral movement of ends 82 of spring clips 80 during assembly and disassembly of handle 40 to receiver 30. Handle 40 can be removed from receiver 30 by depressing ends 82 of spring clips 80 through holes 32 of receiver 30 and simultaneously pulling handle 40 away from receiver 30.

End 42 of handle 40 includes internal cavity 41 for housing RFID tag 60. Each side of cavity 41 includes a graduated guide ramp, 43, which slopes downward from the pan-side end of handle 40 toward the interior of cavity 41. Ramp 43 leads to channel 45 which extends into cavity 41. During assembly, RFID tag 60 is inserted into cavity 41 of handle 40, ramps 43, located on each side of cavity 41, guide tag 60 into channels 45. When fully assembled, channels 45 hold RFID tag 60 generally parallel to the cook-top surface, providing optimum signal transmission between the antenna of RFID tag 60 and the antenna of the reader/writer. As any condensation or moisture within cavity 41 can harm tag 60, handle 40 includes notch 47 located at the pan-side end to permit drainage of any moisture that accumulates within cavity 41.

Although handle 40 can be constructed from any suitable material, handle 40 is preferably molded of a phenolic resin commonly used for pot and pan handles of the prior art. Use of a phenolic resin to mold handle 40 provides for quick and easy production of a unitary handle including cutaway relief 46, grooves 48, ramps 49, cavity 41, notch 47 and all other components of handle 40. Use of alternate materials that are not suitable for molding or casting would require machining of handle 40 to provide such components as cutaway relief 46, grooves 48, ramps 49, cavity 41, and notch 47. In addition, a phenolic material provides minimal interference to the transmission between RFID tag 60 and the reader/writer in the stove-top.

As is shown in FIG. 5, sensor 70 is partially imbedded within the wall of pan body 20. Notch 22 extends slightly more than half way into the thickness of the wall of pan body 20, permitting sufficient contact between sensor 70 and the aluminum core of pan body 20, while also maintaining the integrity of the pan structure, particularly the integrity of the interior cooking surface of pan body 20. Partially imbedding sensor 70 within pan body 20 basically provides three points of contact between sensor 70 and pan body 20, one at inner face 23 of notch 22, and one on each of sides 24 and 26 of notch 22. Such an arrangement maintains a more stable connection between sensor 70 and pan body 20 that is less impacted by thermal expansions and contractions during heating and cooling of the object, than is possible with surface connections used in prior art devices. In addition, partially imbedding temperature sensor 70 into pan body 20 locates sensor 70 closer to the food being cooked within object 10, providing a more accurate temperature for cooking purposes than the prior art surface-mounted sensors.

In a preferred embodiment, temperature sensor 70 is a resistance temperature detector (RTD), which changes electrical resistance with the change of temperature. The electrical resistance of RTD sensor 70 is measured by RFID tag 60 which is connected to sensor 70 by wires 62. RFID tag 60 then transmits temperature information to the reader/writer located within the stove so that the power level provided by the stove can be adjusted accordingly by a controller within the stove to maintain the desired cooking temperature. The temperature information transmitted from tag 60 to the stove can be the resistance measurement, or alternatively, the actual temperature reading based upon the resistance measurement. In a preferred embodiment, tag 60 includes a microprocessor connected to sensor 70 via wires 62. The microprocessor stores specification information regarding sensor 70, such as a resistance measurement to temperature table, and using the resistance measurement obtained from sensor 70 along with the specification information, calculates the temperature. Tag 60 then transmits the temperature to the reader/writer in the stove-top to be used by control algorithms of the stove-top controller. In an alternative embodiment, tag 60 transmits the resistance measurement directly to the stove-top controller and the controller will calculate the temperature. In this embodiment, it will be necessary for the stove-top controller to obtain specification information regarding sensor 70 to calculate the temperature. Such information can be stored in tag 60 and transmitted to the controller along with the resistance measurement.

The side-notch location of temperature sensor 70 described in connection with FIGS. 3 through 8, provides considerable versatility for materials in construction of cookware object 10. In particular, the total thickness of the walls of pan body 20 can vary in thickness regardless of the diameter of sensor 70. As is seen in FIG. 5, sensor 70 can have a diameter greater than the total thickness of the wall of pan body 20, and partly protrude from the exterior surface of pan body 20. Such an arrangement is beneficial it situations in which it is desirable to have relatively thin walls for the pan body. Nevertheless, the location of the temperature sensor at the side of pan body 20 does not provide the optimum temperature reading for temperature regulation of the cookware. The optimum temperature reading is generally found at the center of the base of the pan body, as this is where the food items are usually positioned, and also where the highest temperature reading will be found. When sensor 70 is positioned at the side-notch location, the temperature at the center of the base of pan body 20 can be estimated using the conductivity constants for the materials of pan body 20. If it is desirable to obtain the exact (rather than estimated) temperature of the center of the base of the pan body, it is necessary to position the temperature at the center of the pan body. FIGS. 11 through 25, discussed below, show several embodiments of heatable cookware objects, and related components, in which the temperature sensor is located at the center of the base of the object. In a first embodiment, the sensor is positioned within a tunnel that extends into the center of the base of the object from the side of the object. In a preferred embodiment, the tunnel is drilled or machined in the object after the object has been manufactured. In a second embodiment, the sensor is within a tunnel that is formed between the bottom of the object and a slab that is connected to the bottom of the object.

Figure 11:
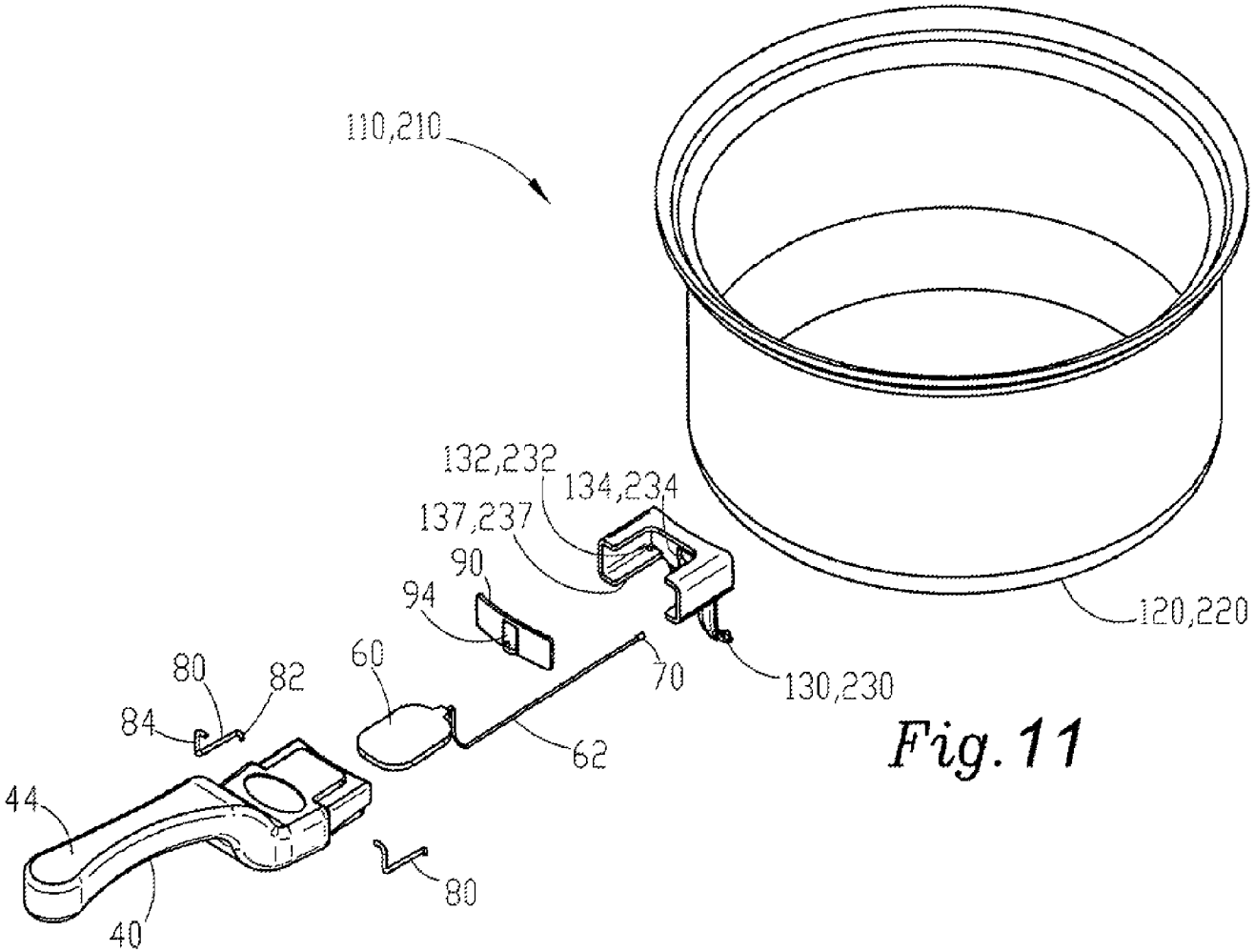
FIG. 11 is an exploded perspective view of a RFID controlled sauce pan exemplary of the instant invention in which a temperature sensor is positioned at the center of the base of the pan.
Figure 12:
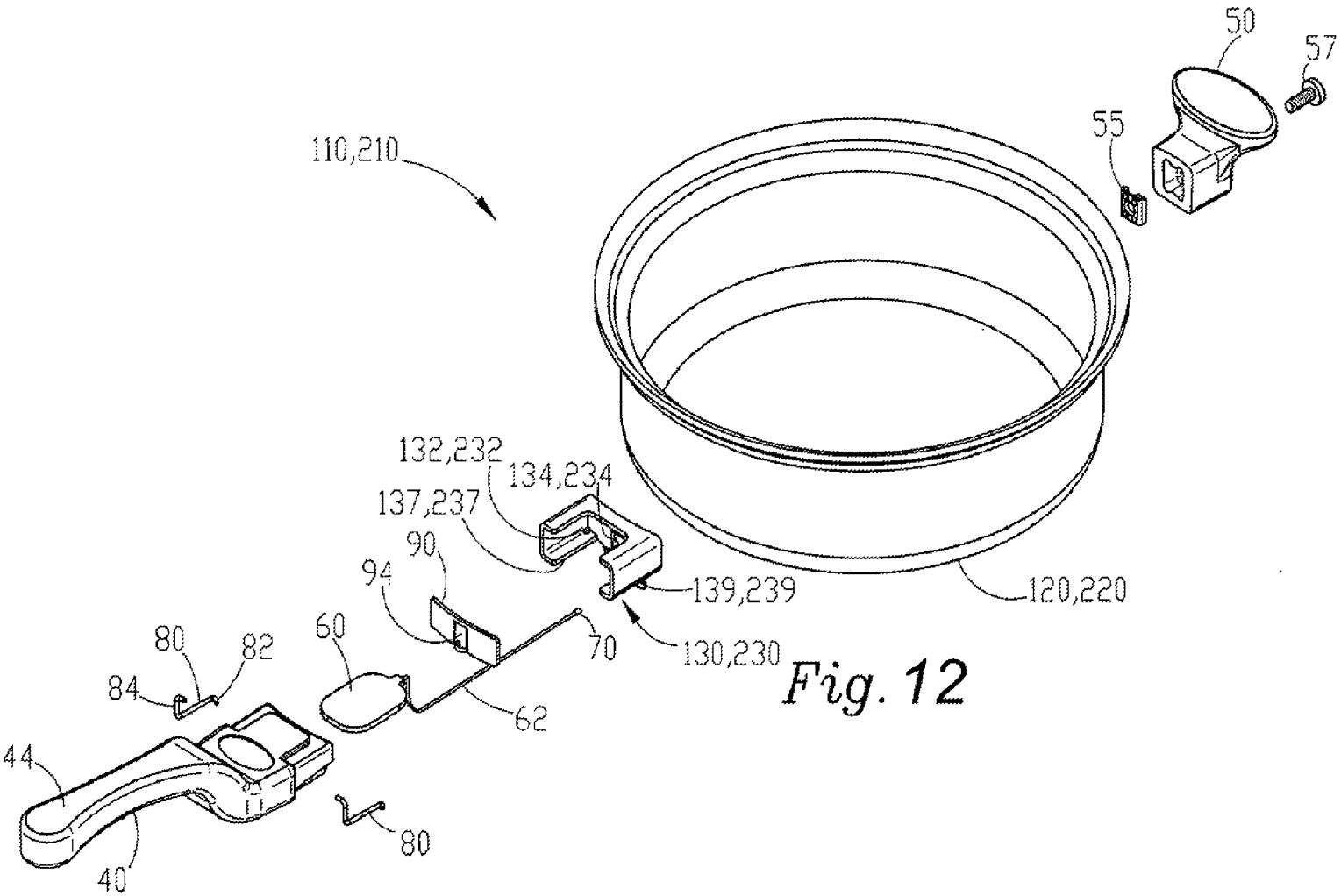
FIG. 12 is an exploded perspective view of a RFID controlled frying pan exemplary of the instant invention in which a temperature sensor is positioned at the center of the base of the pan.
Figure 13:
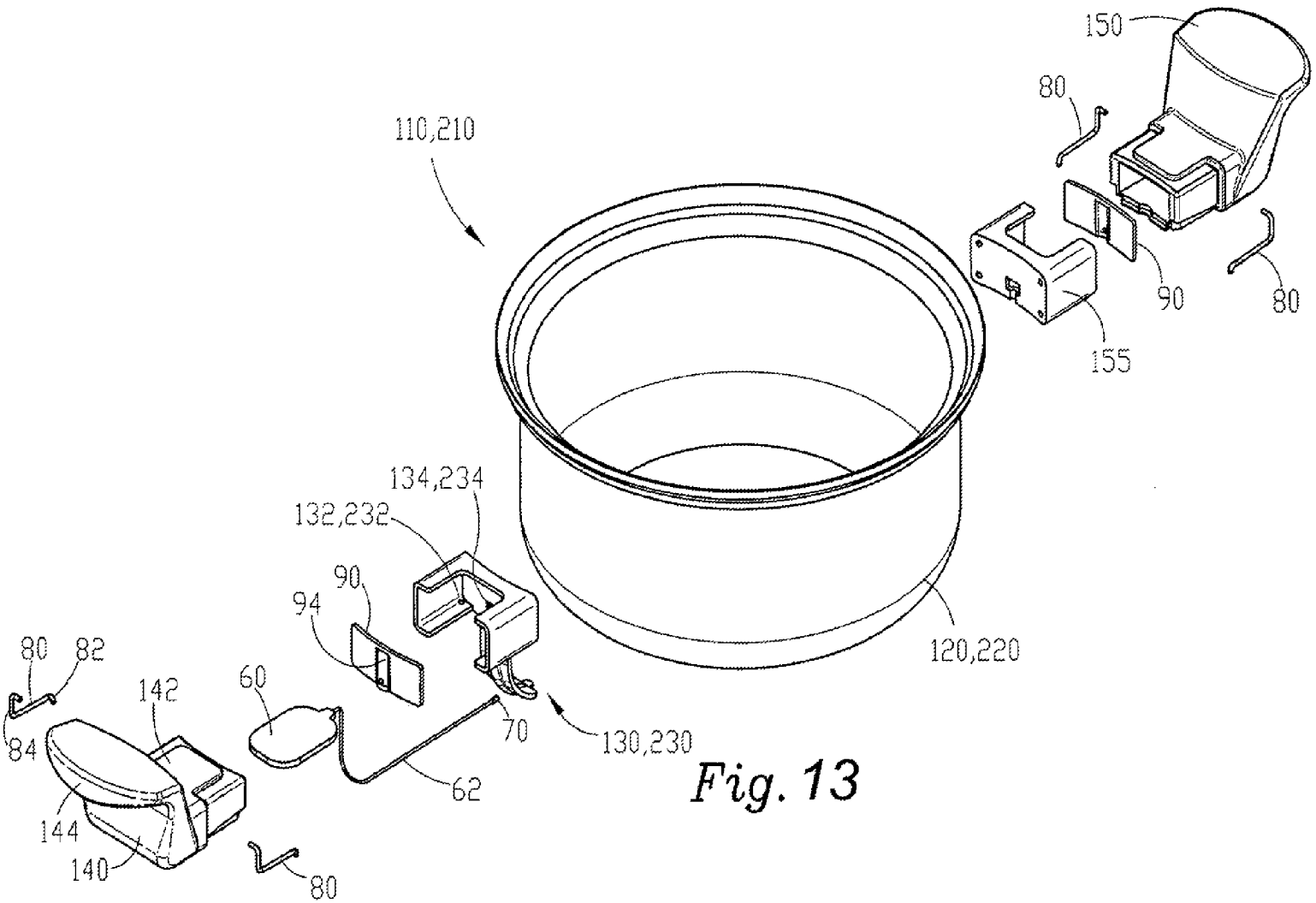
FIG. 13 is an exploded perspective view of a RFID controlled pot exemplary of the instant invention in which a temperature sensor is positioned at the center of the base of the pot.

FIGS. 11 through 13 show exploded views of three different types of pans, 110, 210, utilizing either a tunnel (110) or a slab bottom (210) to locate a temperature sensor at the center of the base of the pan. While both the tunnel, 110, and the slab bottom, 210, embodiments enable location of the temperature sensor at the center of the base of pan 110, 210, each embodiment provides several unique advantages. Tunnel pan 110 results in pan body 120 having a unitary construction, and generally positions the temperature sensor in relatively close proximity to the food item being cooked, as opposed to slab bottom pan 220. Nevertheless, the wall thicknesses of pan body 120 will usually be thicker than those of pan body 220 and also pan body 20 of the side notch embodiment, 10, (discussed above), so as to allow the temperature sensor to become fully imbedded in pan body 120. Other advantages of the various embodiments of the instant invention will become apparent through the following description.

FIG. 11 shows an exploded view of cookware object 110, 210 including pan body 120, 220 in the form of a two quart saucepan or pot. Saucepan 110, 210 also includes handle 40, which is of identical construction as handle 40 discussed above. Handle 40 is connected to pan body 120, 220 via bracket/receiver 130, 230. Spring clips 80 (identical to those discussed above) releasably secure handle 40 to receiver 130, 230 through the engagement of clip ends 82 with holes 132, 232 in receiver 130, 230. An RFID tag, 60 (identical to that discussed above), is connected to temperature sensor 70 (identical to that discussed above) via a pair of wires, 72 (identical to those discussed above, but longer to extend to the center of the pan base). RFID tag 60 is stored in a cavity located within handle 40. Gasket 90, made of high temperature silicon, is located between receiver 130, 230 and handle 40 to thermally shield tag 60 from radiating heat of the pan sidewall, aiding in maintaining the temperature within the cavity of handle 40 below the desired maximum operating temperature of tag 60 (generally 100.degree. C.). Wires 72 extend from the interior of the cavity through portal 94 of silicon gasket 90, through portal 134, 234 of receiver 130, 230, between receiver 130, 230 and the exterior of pan body 120, 220, and to sensor 70 which is generally located between at the center of the base of pan body 120, 220.

FIG. 12 shows an exploded view of cookware object 110, 210 including pan body 120, 220 in the form of a frying pan similar to pan 10 discussed above. Pan 110, 210 includes primary handle 40, and secondary (helper) handle 50, both of which are of identical construction as primary handle 40 and helper handle 50 discussed above. Primary handle 40 is connected to pan body 120, 220 via bracket/receiver 130, 230. Lateral member 139, 239 of receiver 130, 230 shown in FIG. 12 is shorter in length to accommodate the shallower frying pan of FIG. 12 than is the same member for the deeper pans shown in FIGS. 11 and 13. Spring clips 80 (identical to those discussed above) releasably secure primary handle 40 to receiver 130, 230 through the engagement of clip ends 82 with holes 132, 232 in receiver 130, 230. Helper handle 50 is connected to pan body 120, 220 via bracket 55 and screw 57. An RFID tag, 60 (identical to that discussed above), is connected to temperature sensor 70 (identical to that discussed above) via a pair of wires, 72 (identical to those discussed above, but longer to extend to the center of the pan base). RFID tag 60 is stored in a cavity located within handle 40. Gasket 90, made of high temperature silicon, is located between receiver 130, 230 and handle 40 to thermally shield tag 60, aiding in maintaining the temperature within the cavity of handle 40 below the desired maximum operating temperature of tag 60 (generally 100.degree. C.). Wires 72 extend from the interior of the cavity through portal 94 of silicon gasket 90, through portal 134, 234 of receiver 130, 230, between receiver 130, 230 and the exterior of pan body 120, 220, and to sensor 70 which is generally located between at the center of the base of pan body 120, 220.

FIG. 13 shows an exploded view of cookware object 110, 210 including pan body 120, 220 in the form of a four quart sauce pan/pot. Pot 110, 210 includes primary handle 140, and secondary (helper) handle 150. Primary handle 140 is connected to pan body 120, 220 via bracket/receiver 130, 230. Spring clips 80 (identical to those discussed above) releasably secure primary handle 140 to receiver 130, 230 through the engagement of clip ends 82 with holes 132, 232 in receiver 130, 230. Helper handle 150 is connected to pan body 120, 220 via bracket 155 and spring clips 80. An RFID tag, 60 (identical to that discussed above), is connected to temperature sensor 70 (identical to that discussed above) via a pair of wires, 72 (identical to those discussed above, but longer to extend to the center of the pan base). RFID tag 60 is stored in a cavity located within handle 140. Gasket 90, made of high temperature silicon, is located between receiver 130, 230 and handle 140 to thermally shield tag 60, aiding in maintaining the temperature within the cavity of handle 140 below the desired maximum operating temperature of tag 60 (generally 100.degree. C.). Another gasket, 90, can also be located between bracket 155 and secondary handle 150 to maintain a cooler operating temperature for handle 150. Wires 72 extend from the interior of the cavity in handle 140 through portal 94 of silicon gasket 90, through portal 134, 234 of receiver 130, 230, between receiver 130, 230 and the exterior of pan body 120, 220, and to sensor 70 which is generally located between at the center of the base of pan body 120, 220.

Primary handle 140 shown in FIG. 13 is constructed in a similar manner to handle 40 discussed above, the primary difference being the arrangement of the grasping ends 44 and 144 of handles 40 and 144, respectively. Handle grasping end 144 extends generally upward from pot-side end 142 of handle 140 and then extends outward away from pot body 120, 220. Grasping end 144 of handle 140 is generally shorter and taller than grasping end 44 of handle 40 to accommodate the deeper pot on which handle 144 is utilized. Generally, shorter handles positioned toward the top of deeper pot bodies are customary in the art to provide better aesthetics and handling of the deeper bodies. Pot-side end 142 of handle 140 is constructed in a manner identical to pan-side end 42 of handle 40, including (but not limited to) the relief-cutaway section, the spring retaining grooves and ramps, internal cavity and the drain notch. Although helper handle 150 does not require an internal cavity for housing an RFID tag, for ease of manufacturing, helper handle 150 is identical to handle 140. In addition, bracket 155 can be identical to receiver 130, 230. In the preferred embodiment shown in FIG. 11, bracket 155 is identical to receiver 130, 230, except that the unnecessary lateral member, 139, 239, is removed.

Figure 14:
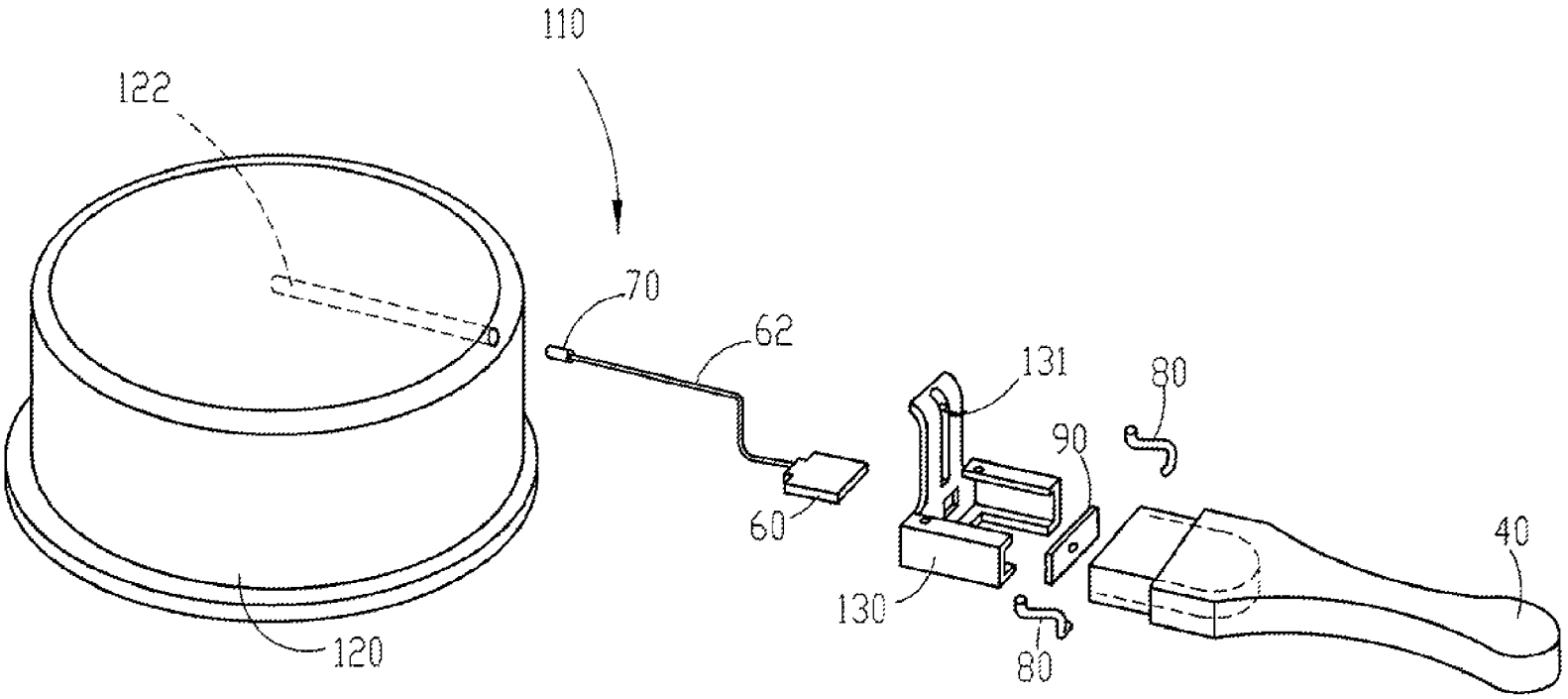
FIG. 14 is an exploded perspective view of a RFID controlled frying pan exemplary of the instant invention in which a temperature sensor is positioned at the center of the base of the pan through the use of a tunnel extending into the base of the pan.

Referring to FIG. 14, an exploded, bottom perspective view of a pan, 110, similar to that presented in FIG. 11, is shown in which tunnel 122 extends to the center of the base of pan body 120. As discussed above with respect to FIG. 11, pan 110 includes handle 40 connected to pan body 120 via bracket/receiver 130. Spring clips 80 releasably secure handle 40 to receiver 130. RFID tag, 60, is connected to temperature sensor 70 via wires, 72, and RFID tag 60 is stored in a cavity located within handle 40. Gasket 90 is located between receiver 130 and handle 40. In a preferred embodiment, tunnel 122 is drilled into the base of pan body 120 after pan body 120 has been manufactured. In this manner, a wide variety of preexisting pan bodies can be utilized without the need of special manufacturing processes for those bodies.

Figure 16:
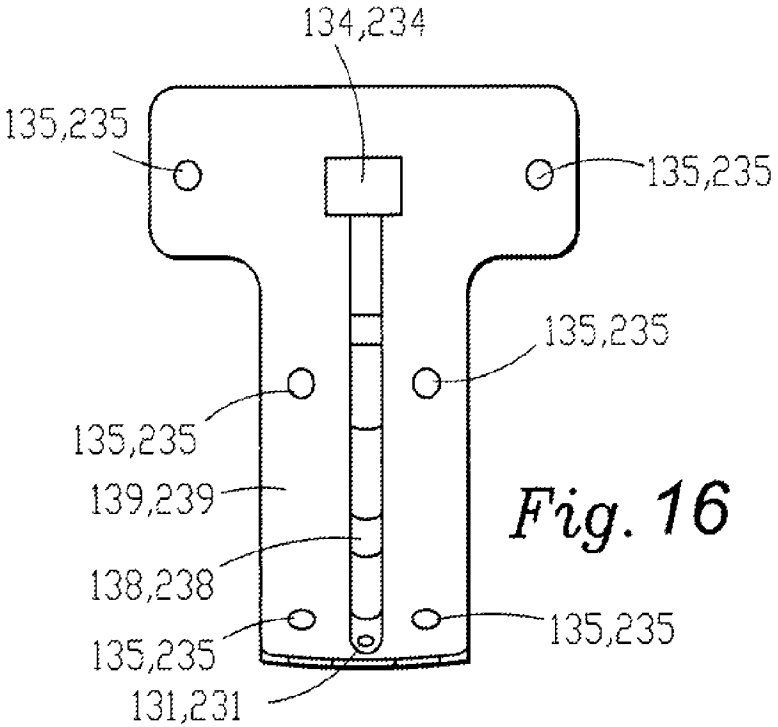
FIG. 16 is a rear elevation view of the receiver of FIG. 15.
Figure 15:
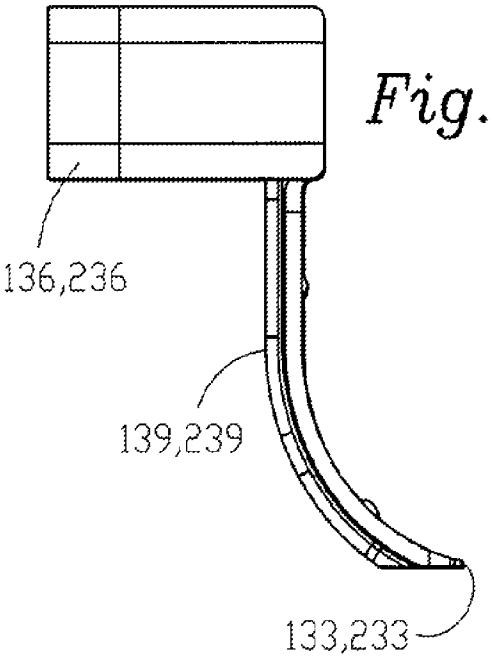
FIG. 15 is a side elevation view of an embodiment of a receiver for connecting the RFID housing handle to any of the pans shown in FIG. 11 through 13.

FIGS. 15 and 16 show detailed views of an embodiment of receiver 130, 230 that can be used with any of the tunnel (110) or slab-bottom (220) pans discussed herein. Receiver 130, 230 is manufactured, operates, and is assembled to pan body 120, 220 in the same or similar manner as that of receiver 30 discussed above. Receiver 130, 230 shall now be described wherein like numbers (i.e. 30, 130, 230) represent similar components to those of receiver 30. Receiver 130, 230 includes opposing support members 136, 236 for engaging the handle, and window 137, 237 located between opposing support members 136, 236. Receiver 130, 230 also includes lateral member 139, 239 extending downward from support members 136, 236 to the base of pan body 120, 220. Channel 138, 238 is formed in member 139, 239 to permit wires 62 to pass through the cavity created between member 139, 239 of receiver 130, 230 and pan body 120, 220. Lateral member 139, 239 includes an end tab, 133, 233, that engages with a notch in the pan body or the bottom slab to provide a clean, generally flush base for the assembled combination of pan body 120, 220 and receiver 130, 230. The inclusion of end tab 133, 233 for insertion into a notch located within the pan body, eliminates the need for locator recess 33 and the associated locator discussed above with respect to receiver 30, as the combination of end tab 133, 233 and the notch in the pan body will ensure proper assembly. As with receiver 30, receiver 130, 230 includes nubs 135, 235 for use in an automated welding/braising assembly process. Receiver 130, 230 further includes injection port 131, 231 near the bottom of lateral member 139, 239 for insertion of a needle or injector. Injection port 131, 231, which is not present in receiver 30, allows for the injection of a silicon potting material, such as Loctite® 5406, to be injected into the tunnel or between the pan body and attached slab, protecting the internal layers of the pan and/or slab and securing the temperature sensor in position.

Figure 18:
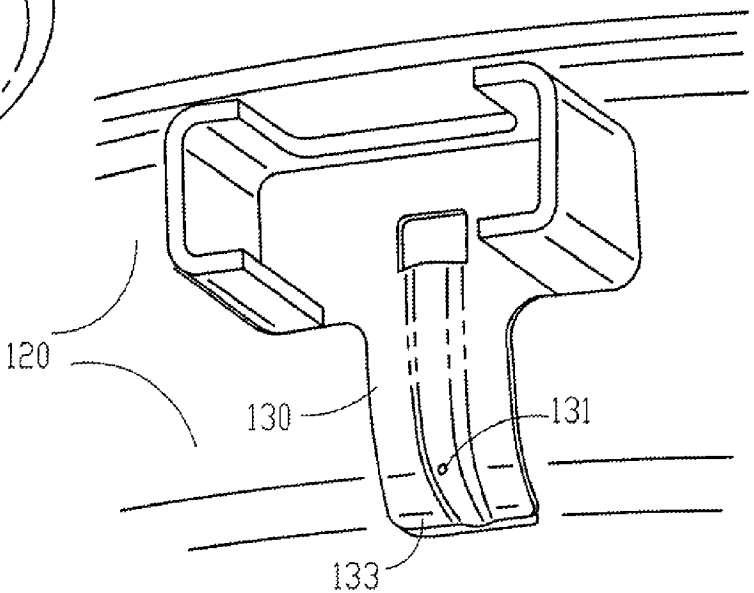
FIG. 18 is a detailed perspective view of the pan of FIG. 17 showing a receiver assembled with the notch.
Figure 17:
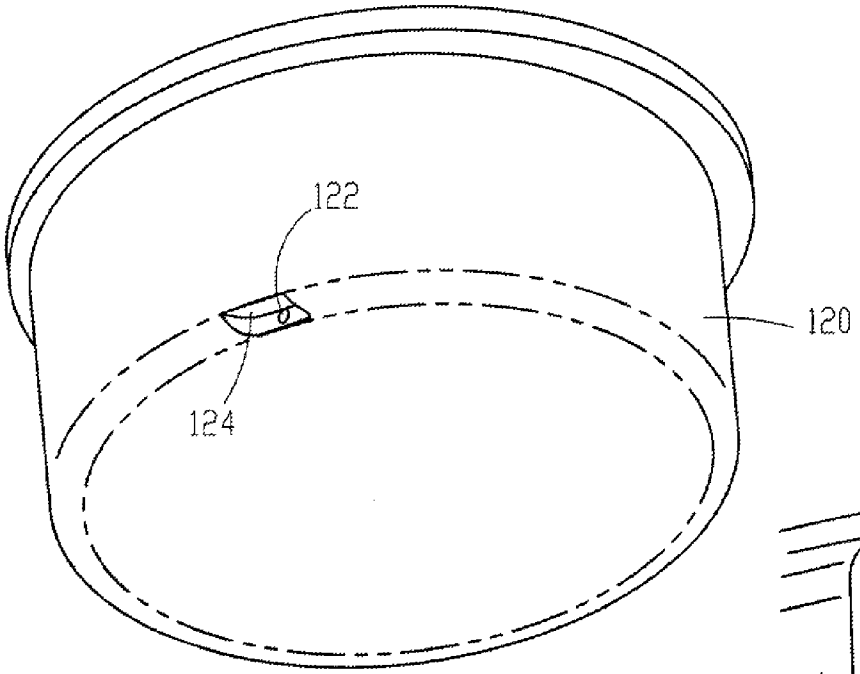
FIG. 17 is a detailed perspective view of the pan of FIG. 14 showing a notch for accepting an end tab of a receiver.

Although end tab 133, 233 shown in FIGS. 15 and 16 includes a generally central tab extending beyond the sides of end tab 133, 233 (as can be seen in FIG. 13), it will be appreciated that end tab 133, 233 can be of any number of shapes and sizes to mate with a corresponding notch in the pan body. For example, FIGS. 17 and 18 show an embodiment of receiver 130 for insertion into notch 124 of pan body 120 wherein end tab 133 of receiver 130 is generally flat. As is shown in FIG. 17, notch 124 is cut, machined or drilled into the perimeter surface of pan body 120 at the end of tunnel 122. Although tunnel 122 shown in FIG. 17 is generally cylindrical, it will be appreciated that the shape of the tunnel may vary depending upon the shape of the temperature sensor. End tab 133 of receiver 130 mates with notch 124 in pan body 120 to form a generally flush connection between pan body 120 and receiver 130. Injection port 131 in receiver 130 allows for insertion of a needle for injecting a potting material into tunnel 122 once receiver 130 has been assembled to pan body 120.

Figure 19:
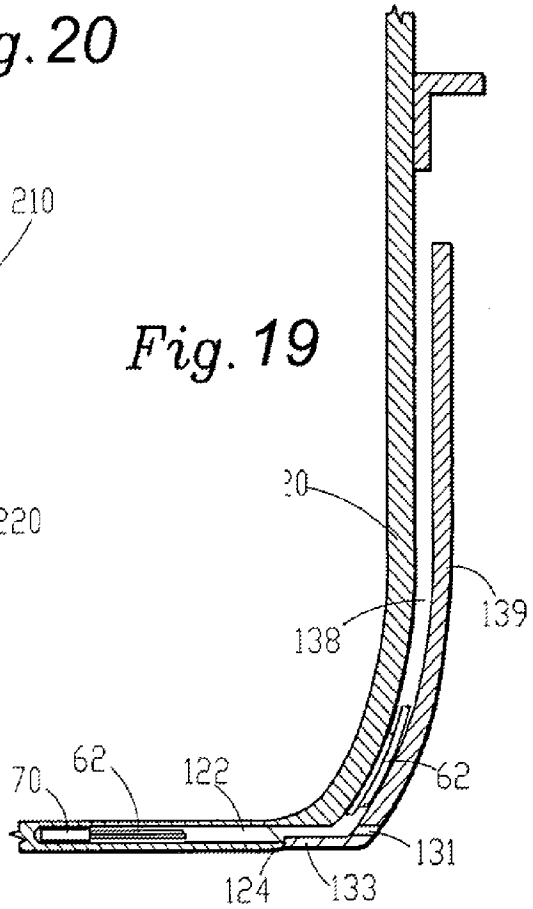
FIG. 19 is a partial section view of the pan of FIG. 14 fully assembled showing the tunnel, receiver and corresponding temperature sensor in detail.

FIG. 19 shows a partial section view of pan 110 presented in FIG. 14 fully assembled. As is shown in FIG. 19, the diameter of tunnel 122 is slightly larger than that of temperature sensor 70. In addition the total diameter of wires 62 is less than the diameter of temperature sensor 70. This provides enough space for insertion of a needle into tunnel 122 when receiver 130 is assembled to pan body 120 and temperature sensor 70 and associated wires 62 are located in tunnel 122. The needle is inserted into tunnel 122 through injection port 131 located at the base of lateral member 139 of receiver 130. As the potting material fills tunnel 122, and surrounds temperature sensor 70 and wire 62, the needle is removed and injection port 131 is closed using a Laser, tig, or similar welding process.

Pan body 120 shown in FIG. 19 is constructed of a 5 ply material as discussed above. The layers of pan body 120 may however be thicker than those discussed above with respect to pan body 20, to allow temperature sensor 70 to be fully imbedded within pan body 120. Tunnel 122 is located within the aluminum core (the three internal layers of the pan body) so that temperature sensor 70 is in contact with the aluminum core. In addition, the stainless steel layers (the two surface layers) are laminated on both sides of each layer to provide better corrosion protection from possible exposure caused by tunnel 122 extending into pan body 120 from its exterior.

Figure 20:
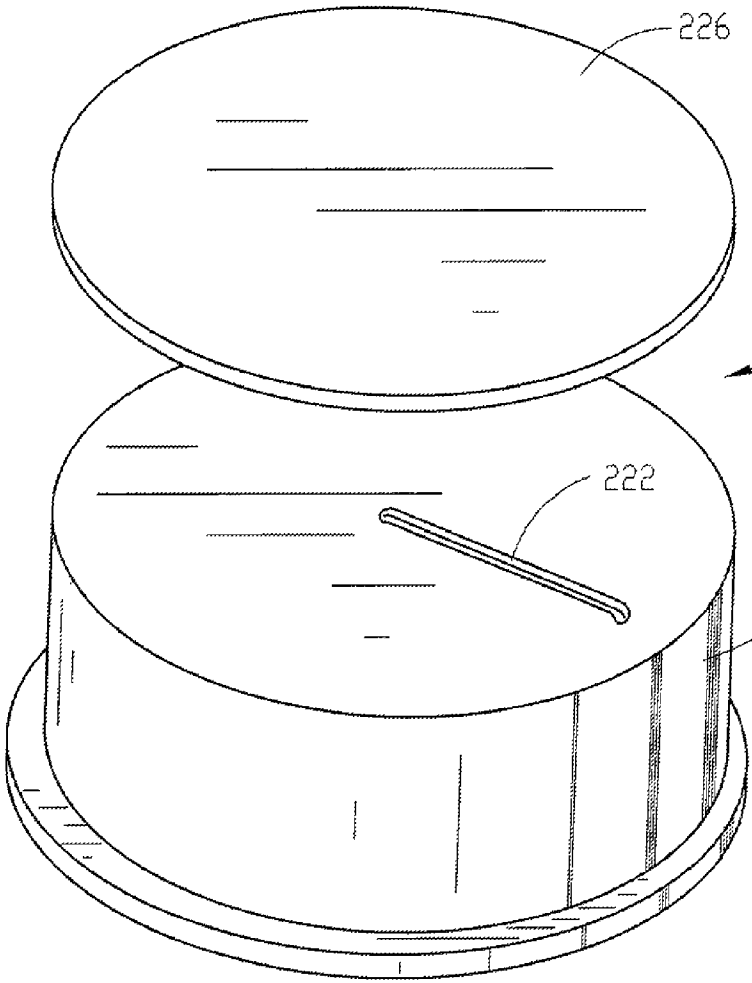
FIG. 20 is an exploded perspective view of a first embodiment of a slab bottom pan having a slot in the base of the pan.

Referring to FIG. 20, an exploded, bottom perspective view of a pan, 210, similar to that presented in FIG. 11, is shown in which slot 222 is milled between the center of the base of pan body 220 to the perimeter of the base of pan body 220. Pan 210 includes a thin slab, 226, made of stainless steel (although a combination of aluminum and stainless steel layers, or any other suitable material can be utilized in alternative embodiments), which is attached to the bottom of pan body 220. Slab 226 is braised to the bottom of pan body 220 using a suitable solder, such as an 1170 melt solder. Although not shown in FIG. 20, pan 210 includes handle 40 connected to pan body 220 via bracket/receiver 230. Spring clips 80 releasably secure handle 40 to receiver 230. RFID tag, 60, is connected to temperature sensor 70 via wires, 72, and RFID tag 60 is stored in a cavity located within handle 40. Gasket 90 is located between receiver 230 and handle 40. In a preferred embodiment, slot 222 is machined into the base of pan body 220 after pan body 220 has been manufactured. In this manner, a wide variety of preexisting pan bodies can be utilized without the need of special manufacturing processes for those bodies. In another preferred embodiment, pan body 220 is of 5 ply construction, as discussed above. In this embodiment, slot 222 is milled into pan body 220 so that sensor 70 is placed in contact with the aluminum core of pan body 220.

FIGS. 21 through 25 show several variations of a second embodiment of pan 210 having a slab attached to the bottom of pan body 220, in which slot 222 is formed in slab 226 instead of being milled in pan body 220. Locating slot 222 within slab 226 allows for a thinner wall thickness for pan body 220, and eliminates the need to perform any machining operations on pan body 220 once the body is manufactured (other than braising slab 226 to pan body 220). In a preferred embodiment of the slab base pan having a slot formed within the slab, slab 226 is constructed of an aluminum layer (or aluminum alloy) and a steel layer (although any other suitable material can be utilized for slab 226 depending upon the conductive, inductive and various other properties desired). Slot 222 is formed in the aluminum layer to position temperature sensor 70 in contact with the heat conductive aluminum to provide a more accurate temperature reading. The steel layer is positioned opposite the side of slab 226 that contacts pan body 220 to provide a durable, attractive finish to pan 210. In addition, the steel layer can be heated by induction if pan 210 is used on an induction stove-top.

Figures 21, 22:
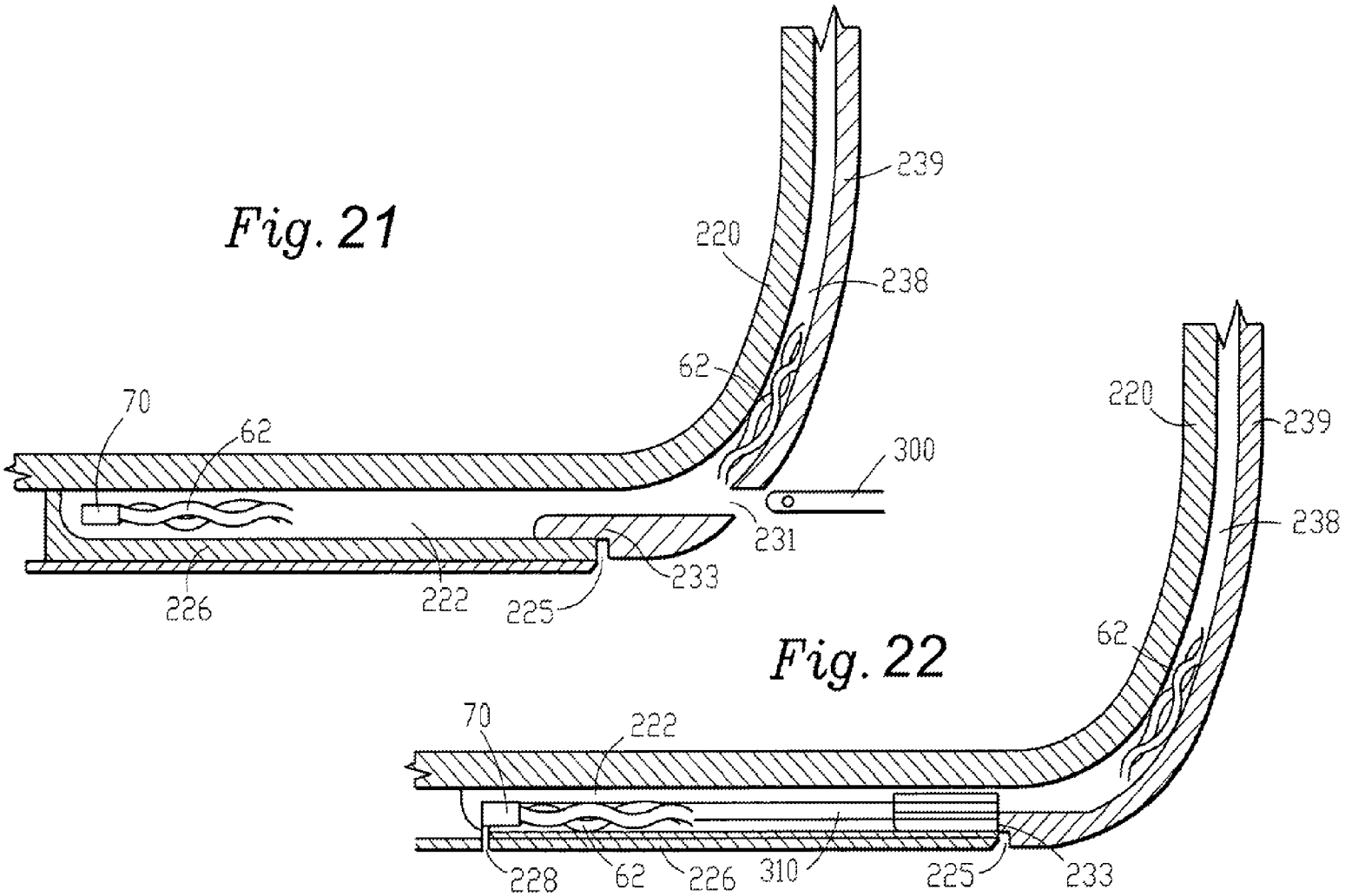
FIG. 21 is a partial section view of second embodiment of a slab bottom pan having a slot in the slab, showing a first embodiment for a receiver.
FIG. 22 is a partial section view of second embodiment of a slab bottom pan having a slot in the slab, showing an alternative embodiment for a receiver.

FIG. 21 shows a partial section view of slab-bottom pan 210 fully assembled having a generally rectangular slot formed in the slab. As is shown in FIG. 21, the height and width of slot 222 milled into slab 226 is slightly larger than that of temperature sensor 70. In addition the total height and width of wires 62 is less than the height and width of temperature sensor 70. This provides enough space for insertion of needle 300 into slot 222 when receiver 230 is assembled to pan body 220 and temperature sensor 70 and associated wires 62 are located in slot 222. Needle 300 is inserted into slot 222 through injection port 231 located at the bottom of lateral member 239 of receiver 230. As the potting material fills slot 222, and surrounds temperature sensor 70 and wires 62, needle 300 is removed and injection port 231 is closed using a Laser, tig, or similar welding process.

The bottom of lateral member 239 of receiver 230 includes tab 233 that fits within slot 222 of slab 226. As is shown in FIG. 21, the bottom of lateral member 239 extends below tab 233 slightly less than the thickness of slab 226 existing below tunnel 222 to provide a generally flush bottom connection between slab 226 and receiver 230. Gap 225 is positioned between the bottom of lateral member 239 of receiver 230 and slab 226 to allow for thermal expansion and contraction to slab 226 and receiver 230 during heating and cooling of pan 210.

FIG. 22 shows a partial section view of slab-bottom pan 210 fully assembled including a generally rectangular slot formed in the slab and a temperature sensor rod attached to receiver 230. Rod 310 is a rigid member that connects sensor 70 to receiver 230 for easier insertion of sensor 70 into pan body 220 during assembly. As is shown in FIG. 22, the height and width of slot 222 milled into slab 226 is slightly larger than that of temperature sensor 70. In addition the total height and width of wires 62 and rod 310 is less than the height and width of slot 222, allowing wires 62, rod 310 and sensor 70 to all fit within slot 222. Micro hole 228 is included at the bottom of slab 226 extending into slot 222. Micro hole 228 allows for the injection of a potting material into slot 222 which surrounds temperature sensor 70 and wires 62. Once the potting material is injected into slot 222, micro hole 228 is closed using a Laser, tig, or similar welding process.

Figure 23:
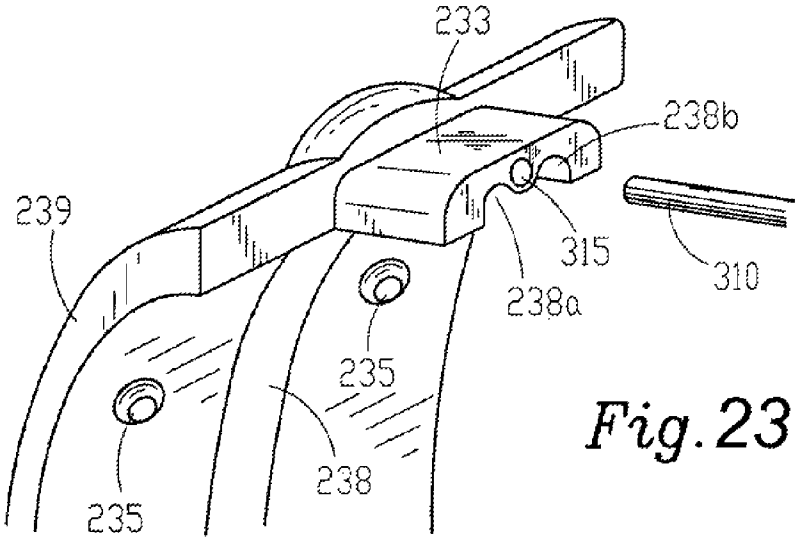
FIG. 23 is a partial perspective view of the receiver presented in FIG. 22.

FIG. 23 shows a bottom perspective view of receiver 230 presented in FIG. 22. The bottom of lateral member 239 of receiver 230 includes tab 233 that fits within slot 222 of slab 226. As is shown in FIG. 23 (and FIG. 22), the bottom of lateral member 239 extends below tab 233 slightly less than the thickness of slab 226 existing below tunnel 222 to provide a generally flush bottom connection between slab 226 and receiver 230. Gap 225 is positioned between the bottom of lateral member 239 of receiver 230 and slab 226 to allow for thermal expansion and contraction to slab 226 and receiver 230 during heating and cooling of pan 210. Rod 310 is positioned within hole 315 located within tab 233. Wire channels 238*a* and 238*b* are included in tab 233 for wires 62 to extend from wire channel 238 of receiver 230 into slot 222.

Figure 24:
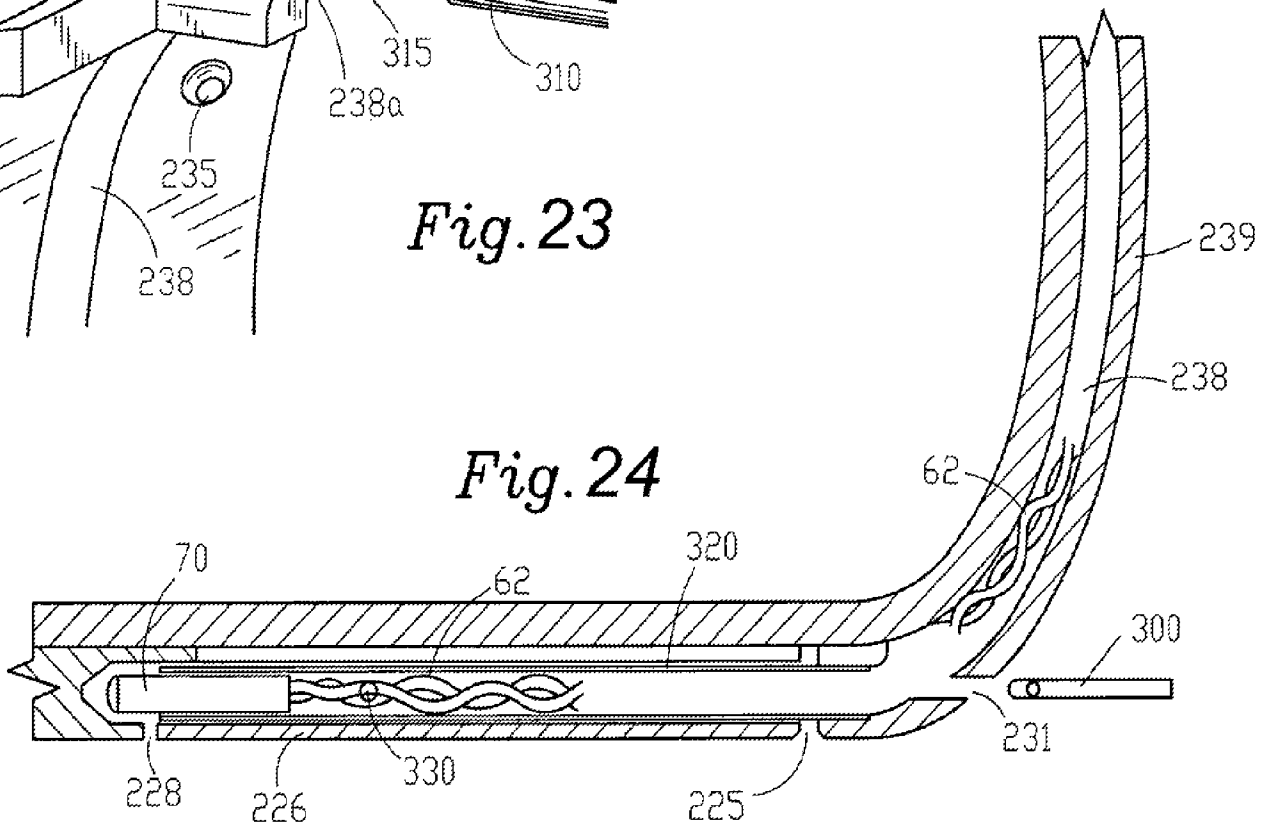
FIG. 24 is a partial section view of second embodiment of a slab bottom pan having a slot in the slab, showing another alternative embodiment for a receiver.

FIG. 24 shows a partial section view of slab-bottom pan 210 fully assembled including a generally cylindrical slot formed in the slab and an insertable tube attached to receiver 230. Tube 320 is a rigid member connected to receiver 230 into which sensor 70 is inserted for easier insertion of sensor 70 into pan body 220 during assembly. Tube 320 surrounds sensor 70 and wires 62, with the end of sensor 70 extending beyond tube 320. As is shown in FIG. 24, the diameter of slot 222 formed into slab 226 is slightly larger than that of tube 320, allowing wires 62, and sensor 70, located within tube 320, to all fit within slot 222. Hole 228 is included at the bottom of slab 226 extending into slot 222 just in front of the end of tube 320. Hole 228 allows for the injection of a potting material into slot 222 which surrounds temperature sensor 70 and tube 320. Once the potting material is injected into slot 222, hole 228 is closed using a Laser, tig, or similar welding process. Receiver 230 also includes injection port 231 for injecting potting material into tube 320. The total diameter of wires 62 is less than the diameter of tube 230. This provides enough space for insertion of needle 300 into tube 320 when receiver 230 is assembled to pan body 220 and tube 320, temperature sensor 70 and associated wires 62 are located in slot 222. Needle 300 is inserted into tube 320 through injection port 231 located at the bottom of lateral member 239 of receiver 230. As the potting material fills tube 320, and surrounds wires 62, needle 300 is removed and injection port 231 is closed using a Laser, tig, or similar welding process.

Figure 25:
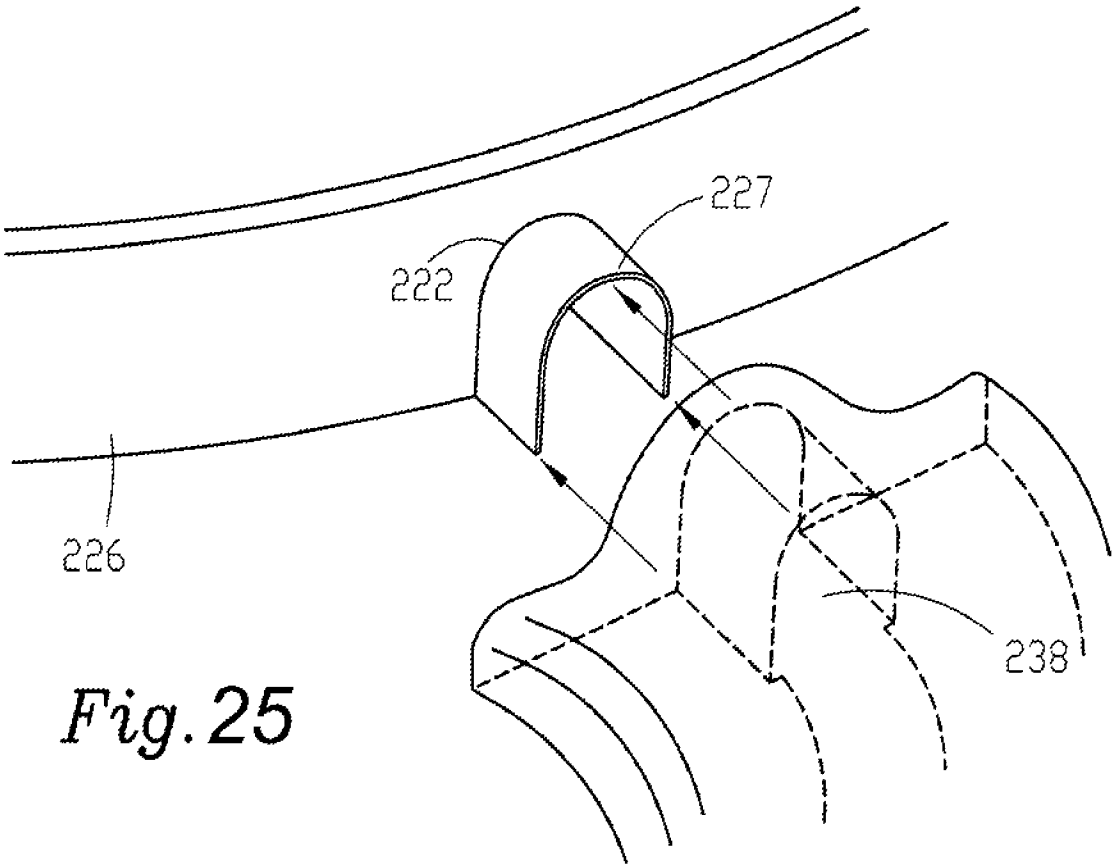
FIG. 25 is a partial perspective view of a second embodiment of a slab bottom pan having a slot in the slab, showing another alternative embodiment for a receiver and a stamped-tunnel slot.

FIG. 25 shows an alternative embodiment of slab-bottom pan 210 including a tunnel formed in slab 226. A stamped stainless steel tunnel, 227, is positioned in slot 222 of slab 226. Tunnel 227 protrudes from the outer perimeter of slab 226 for engagement with wire channel 238 of receiver 230.

Once the temperature controllable objects discussed above (either 10, 110, or 210) have been manufactured and assembled, the RFID tags are initialized and control algorithms and data are downloaded to the tags. The control algorithms and data can include such information as the class of the object, i.e. sauce pan, frying pan, serving tray, warming dish, etc. In addition, information regarding the location of the temperature sensor can be included (i.e. side notch, bottom center, etc.) for use in determining ideal cooking temperatures. Heating characteristics, such as conductivity of the materials of the object, thickness, number of layers, etc., can also be downloaded to the tag, or alternatively these characteristics can be used in determining the class of the object.

It will be appreciated that components from any of the embodiments of heatable objects discussed above can be interchanged with similar components of any of the other embodiments of heatable objects discussed herein. For example, the insert rod or insertable tube receivers discussed in connection with pans 210 could be utilized in connection with pans 110. Likewise, handles 40, 140, 50, and 150, as well as silicon gasket 90, and handle mounting hardware, can be interchangeably utilized on any of pans 10, 110, and 210. In addition, the methods of manufacturing and locating the temperatures sensors (i.e. side-notch 10, tunnel-bottom 110, or bottom-slab 210) can be interchangeably utilized with any of the various pots and pans discussed an shown herein, as well as in any cookware, servingware or other heatable objects now known or later discovered.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A temperature control interface for a stovetop comprising:

a temperature control selector for manually selecting a temperature;

a numerical temperature setting displayed on a temperature control interface;

a temperature sensor to measure the temperature of a cookware object placed on a stovetop hob; and a processor to control the power of said stovetop hob to regulate the temperature of said cookware object placed on said stovetop hob for a predetermined period of time.

2. The temperature control interface as claimed in claim 1 further comprising:

a processor to control the power of said stovetop hob to regulate the temperature of said cookware object placed on said stovetop hob for a second predetermined period of time.

3. The temperature control interface as claim in claim 1 further comprising:

a timing control selector for manually selecting said predetermined period of time.

4. The temperature control interface as claim in claim 2 further comprising:

a timing control selector for manually selecting said second predetermined period of time.

5. The temperature control interface as claimed in claim 1 wherein said processor controls the power of said stovetop hob to regulate the temperature of said cookware object placed on said stovetop hob for a predetermined period of time at a first predetermined temperature.

6. The temperature control interface as claimed in claim 2 wherein said processor controls the power of said stovetop hob to regulate the temperature of said cookware object placed on said stovetop hob for said second predetermined period of time at a second predetermined temperature.

7. The temperature control interface as claimed in claim 1 wherein said temperature control selector and said numerical temperature setting display are a single unit.

8. The temperature control interface as claimed in claim 1 wherein said temperature control selector and said numerical temperature setting display are separable.

9. The temperature control interface as claimed in claim 1 further comprising a processor to control the power of a stovetop hob to regulate the temperature of said stovetop hob.

10. The temperature control interface as claimed in claim 1 wherein if the temperature measured by said temperature sensor is lower than the temperature set by said temperature control selector, the power to said stovetop hob is either increased or maintained; and if the temperature measured by said temperature sensor is higher than or equal to the temperature set by said temperature control selector, the power to said stovetop hob is decreased.

11. A method of cooking on a stovetop comprising the steps of:

measuring the temperature of a cookware object that is placed on a hob of the stovetop;

manually setting a numerical temperature and displaying said set temperature on a temperature control interface to which said set temperature of said cookware object is to be regulated for a predetermined period of time; and controlling the power of said hob to regulate said set temperature of said cookware object for said predetermined period of time.

12. The method of claim 11, wherein said temperature control interface comprises the temperature control interface as claimed in claim 1.

13. The method of claim 11, further comprising setting said numerical temperature setting on said temperature control interface to a specific numerical temperature value acquired from a recipe.

14. The method of claim 11, further comprising controlling the power of said hob to regulate the temperature of said cookware object for a second predetermined period of time.

15. The method of claim 11, further comprising:

setting a second numerical temperature and displaying said second set temperature on a temperature control interface to which said temperature of said cookware object is to be regulated for a second predetermined period of time.

* * * * *